US008315534B2

(12) United States Patent
Yano et al.

(10) Patent No.: US 8,315,534 B2
(45) Date of Patent: Nov. 20, 2012

(54) IMAGE FORMING DEVICE TO SUPPLY DC POWER TO A LOAD FROM BOTH A MAIN POWER SUPPLY DEVICE AND A CAPACITOR SUPPLY DEVICE

(75) Inventors: Tetsuya Yano, Kanagawa (JP); Toshitaka Semma, Kanagawa (JP); Yoshihisa Kimura, Kanagawa (JP); Norio Muraishi, Tokyo (JP); Naoki Sato, Kanagawa (JP); Kazuhito Kishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1085 days.

(21) Appl. No.: 11/554,944

(22) Filed: Oct. 31, 2006

(65) Prior Publication Data

US 2007/0098433 A1 May 3, 2007

(30) Foreign Application Priority Data

Nov. 1, 2005 (JP) ..... 2005-318775
Nov. 30, 2005 (JP) ..... 2005-346366

(51) Int. Cl.
*G03G 15/00* (2006.01)

(52) U.S. Cl. ..... 399/88

(58) Field of Classification Search ..... 399/88
See application file for complete search history.

(56) References Cited

U.S. PATENT DOCUMENTS 6,109,464 A 8/2000 Takano
6,317,147 B1 * 11/2001 Tanaka ..... 347/116
6,542,705 B2 4/2003 Fujita et al.
7,002,112 B2 2/2006 Kishi et al.
7,010,255 B2 3/2006 Yura et al.
7,054,570 B2 5/2006 Kishi et al.
7,116,923 B2 10/2006 Kishi et al.
7,122,767 B2 10/2006 Sato et al.

(Continued)

FOREIGN PATENT DOCUMENTS

JP 7-41023 2/1995

(Continued)

OTHER PUBLICATIONS

Office Action issued Jul. 12, 2011 in Japanese Patent Application No. 2005-318775.

(Continued)

*Primary Examiner* — Walter L Lindsay, Jr.
*Assistant Examiner* — Milton Gonzalez
(74) *Attorney, Agent, or Firm* — Oblon, Spivak, McClelland, Maier & Neustadt, L.L.P.

(57) ABSTRACT

Stored DC power is supplied to a load after a return to a normal-power mode or a power-up of an image forming device. An auxiliary power supply does not supply the stored DC power to the load, and a main power supply supplies AC and DC power to the load if it is determined that a predetermined processing is performed upon a starting of the image forming device. The auxiliary power supply supplies the stored DC power to the load, it is determined whether a predetermined time has elapsed, and the main power supply does not supply the AC and DC power to the load if it is determined that the predetermined processing is not performed upon the starting of the image forming device. A decision whether the predetermined processing is performed is based on at least one of a number of sheets, an elapsed time, and an environmental temperature.

11 Claims, 22 Drawing Sheets

U.S. PATENT DOCUMENTS

| | | | | |
|---|---|---|---|---|
| 7,127,189 | B2 | 10/2006 | Takamatsu et al. | |
| 7,130,555 | B2 | 10/2006 | Kishi et al. | |
| 7,164,870 | B2 | 1/2007 | Satoh | |
| 7,260,337 | B2 | 8/2007 | Koyama et al. | |
| 7,277,651 | B2 | 10/2007 | Hanamoto et al. | |
| 2004/0245235 | A1 | 12/2004 | Kishi et al. | |
| 2004/0245241 | A1 | 12/2004 | Kishi et al. | |
| 2005/0123314 | A1 | 6/2005 | Satoh | |
| 2005/0123315 | A1 | 6/2005 | Kishi et al. | |
| 2005/0139584 | A1 | 6/2005 | Kishi et al. | |
| 2005/0169657 | A1* | 8/2005 | Hanamoto et al. | 399/88 |
| 2005/0175368 | A1 | 8/2005 | Matsusaka et al. | |
| 2005/0175370 | A1* | 8/2005 | Matsusaka et al. | 399/88 |
| 2005/0189923 | A1 | 9/2005 | Ohishi et al. | |
| 2005/0191078 | A1 | 9/2005 | Kishi et al. | |
| 2005/0220474 | A1 | 10/2005 | Sato et al. | |
| 2005/0232651 | A1 | 10/2005 | Sato et al. | |
| 2006/0024079 | A1 | 2/2006 | Sato et al. | |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1* | 6/2006 | Kishi et al. | 399/69 |

FOREIGN PATENT DOCUMENTS

| | | |
|---|---|---|
| JP | 2002-199588 | 7/2002 |
| JP | 2002-278352 | 9/2002 |
| JP | 2004-236492 | 8/2004 |
| JP | 2005-166633 | 6/2005 |
| JP | 2005-221674 | 8/2005 |
| JP | 2005-221675 | 8/2005 |
| JP | 2005-221676 | 8/2005 |
| JP | 2006171089 A * | 6/2006 |

OTHER PUBLICATIONS

Office Action issued Jan. 18, 2011 in Japan Application No. 2005-346366.

Office Action issued Mar. 1, 2011 in Japan Application No. 2005-318775.

* cited by examiner

FIG.5

| | | SETTING OF SWITCHES | | |
|---|---|---|---|---|
| | | SW83 | SW84 | SW85 |
| MODE | STANDBY | ON | ON | ON |
| | LOW-POWER | OFF | ON | ON |
| | PAUSE | OFF | OFF | OFF |

FIG.6

| | | EXECUTABLE FUNCTION: ○ | | | | | |
|---|---|---|---|---|---|---|---|
| | | INPUT DETECT | IMAGE READ | COPY | PRINT | FAX | DATA STORE |
| MODE | STANDBY | ○ | ○ | ○ | ○ | ○ | ○ |
| | LOW-POWER | ○ | ○ | | | ○ | ○ |
| | PAUSE | ○ | | | | ○ | ○ |

IMAGE FORMING DEVICE TO SUPPLY DC POWER TO A LOAD FROM BOTH A MAIN POWER SUPPLY DEVICE AND A CAPACITOR SUPPLY DEVICE

BACKGROUND OF THE INVENTION

1. Field of the Invention

The present invention generally relates to an image forming device, and more particularly to an image forming device which supplies electric power from an auxiliary power supply to a DC load such that power consumption of the image forming device is kept from exceeding the electric power which can be supplied by the power supply line.

2. Description of the Related Art

In recent years, multi-function peripherals have come to have an increasing number of image forming functions including a copying function, a printer function, a facsimile function and others that use the electrophotographic printing process. In connection with this, the multi-function peripherals have a complicated structure, and the maximum electric power consumption of them tends to increase.

In order to reduce the factors of the image forming device and the operator's waiting time, such as a waiting time for the warm-up of the fixing device or a temporary interruption of operation due to a fall of the fixing temperature under print or copy operation, the amount of electric power supplied to the fixing heater tends to increase.

On the other hand, the electric power that can be supplied from the power supply line is usually limited, and this is a significant restriction when the design of the image forming device is determined.

SUMMARY OF THE INVENTION

According to one aspect of the invention, there is provided an improved image forming device in which the above-described problems are eliminated.

According to one aspect of the invention there is provided an image forming device which enables the supplying of DC power from an auxiliary power supply, which is constructed with a simple structure, to a DC load, such that the power consumption of the image forming device is kept from exceeding the permissible electric power capacity even if a steep change of the load occurs.

According to one aspect of the invention there is provided an image forming device which enables the shortening of the time for starting of the image forming device including starting of a fixing heater after power-up of the image forming device or return from a low-power mode occurs.

BRIEF DESCRIPTION OF THE DRAWINGS

Other objects, features and advantages of the present invention will be apparent from the following detailed description when reading in conjunction with the accompanying drawings.

FIG. 5 is a diagram showing the relation between respective operation modes of the multi-function peripheral and ON/OFF of electric supply switches.

FIG. 6 is a diagram showing information processing items which are active in each mode.

DETAILED DESCRIPTION OF PREFERRED EMBODIMENTS

A description will be given of embodiments of the invention with reference to the accompanying drawings.

Figure 19:
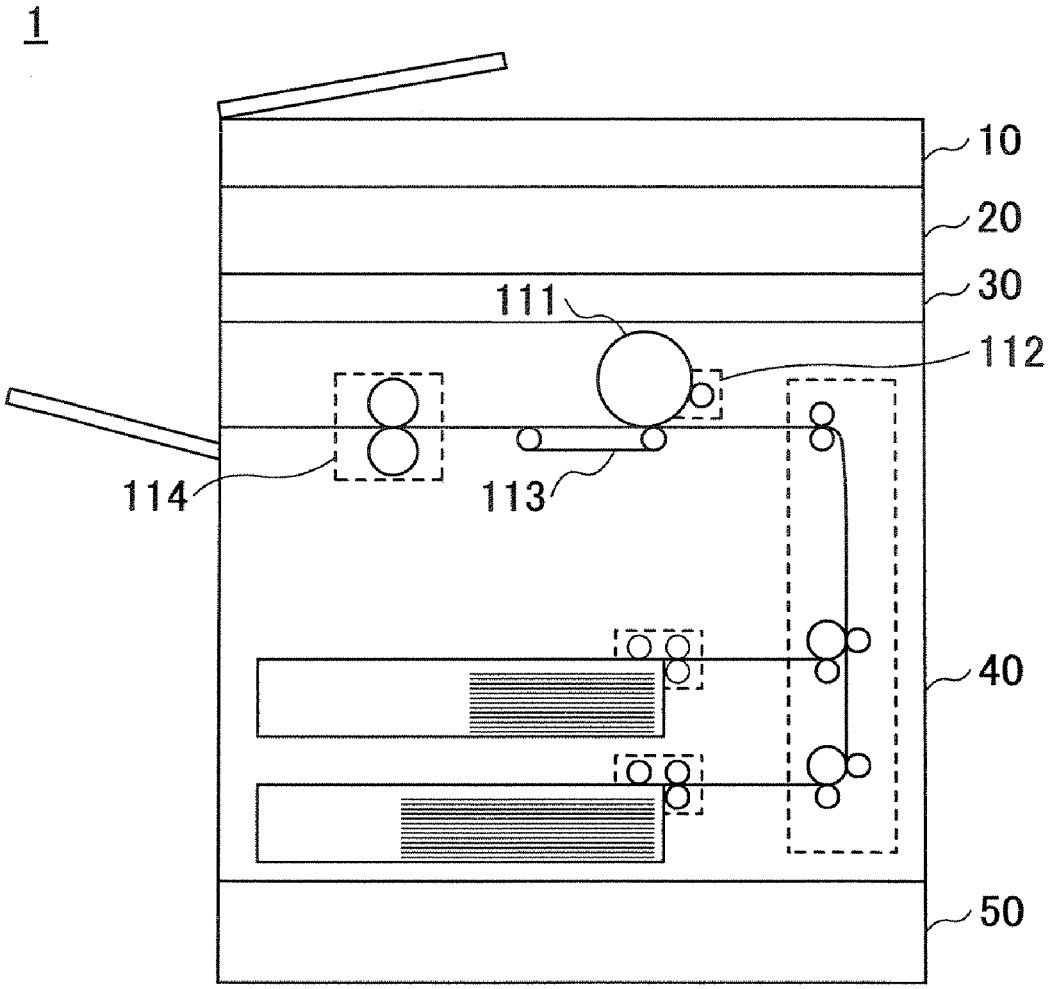
FIG. 19 is a cross-sectional view showing the composition of an image forming device in an embodiment of the invention.

FIG. 19 is a cross-sectional view showing the outline composition of an image forming device in an embodiment of the invention.

As shown in FIG. 19, the image forming device 1 is a digital multi-function peripheral, and has a copy function, a printer function, a facsimile function, etc. It is possible to change these functions one by one by the application change key of a control unit (not shown), and to choose, and becomes facsimile mode at the time of selection of a printer mode and a facsimile function at the time of copy mode and selection of a printer function at the time of selection of a copy function.

The image forming device 1 comprises an automatic document feeder (ADF) 10, an image reader 20, an optical writing unit 30, a printer unit 40, and a capacitor unit 50.

The ADF 10 is provided to automatically feed the document which is placed on the image reader 20. The image reader 20 is provided to read the image information contained in the document sent by the ADF 10.

The optical writing unit 30 is provided to convert the image information read by using the image reader 20, into optical information. The printer unit 40 is provided to transfer the image which is the same as that in the read document, to the sheet based on the optical information produced by the optical writing unit 30. The printer unit 40 comprises a photoconductor drum 111, a developing unit 112, a transport belt 113, and a fixing device 114.

The photoconductor drum 111 is provided to form an electrostatic latent image thereon, when it is exposed by the optical information from the optical writing unit 30.

The developing unit 112 is provided to develop the electrostatic latent image formed on the photoconductor drum 111, by toner so that a toner image is formed on a sheet. The transport belt 113 is provided to transfer the sheet to the position where the toner image is formed by the developing unit 112.

The fixing device 114 is provided to fix the toner image transferred by the transport belt 113, to the sheet and eject the sheet on which the toner image is formed. The capacitor unit 50 is the auxiliary power supply to the DC load of the image forming device.

Next, the copy function of the image forming device 1 will be described as an example of the multiple image forming functions mentioned above, and operation of the image forming device 1 will be explained.

When the documents of two or more sheets are put on the ADF 10, the ADF 10 feeds one document at a time to the image reader 20 sequentially. The image reader 20 reads the image information of the document.

After the image information read by the image reader 20 is subjected to image compensation and processing carried out by an image processing unit (not shown), it is converted into optical information by the optical writing unit 30. In accordance with this optical information, the surface of the photoconductor drum 111, uniformly charged by the charging device (not shown), is exposed, so that an electrostatic latent image is formed on the photoconductor drum 111.

The electrostatic latent image formed on the photoconductor drum 111 is developed by the developing unit 112, and it is turned into a toner image. This toner image is transferred to the sheet by the transport belt 113, and it is fixed to the sheet by the fixing device 114.

Finally, the sheet on which the toner image is formed is ejected from the fixing device 114.

Figure 20:
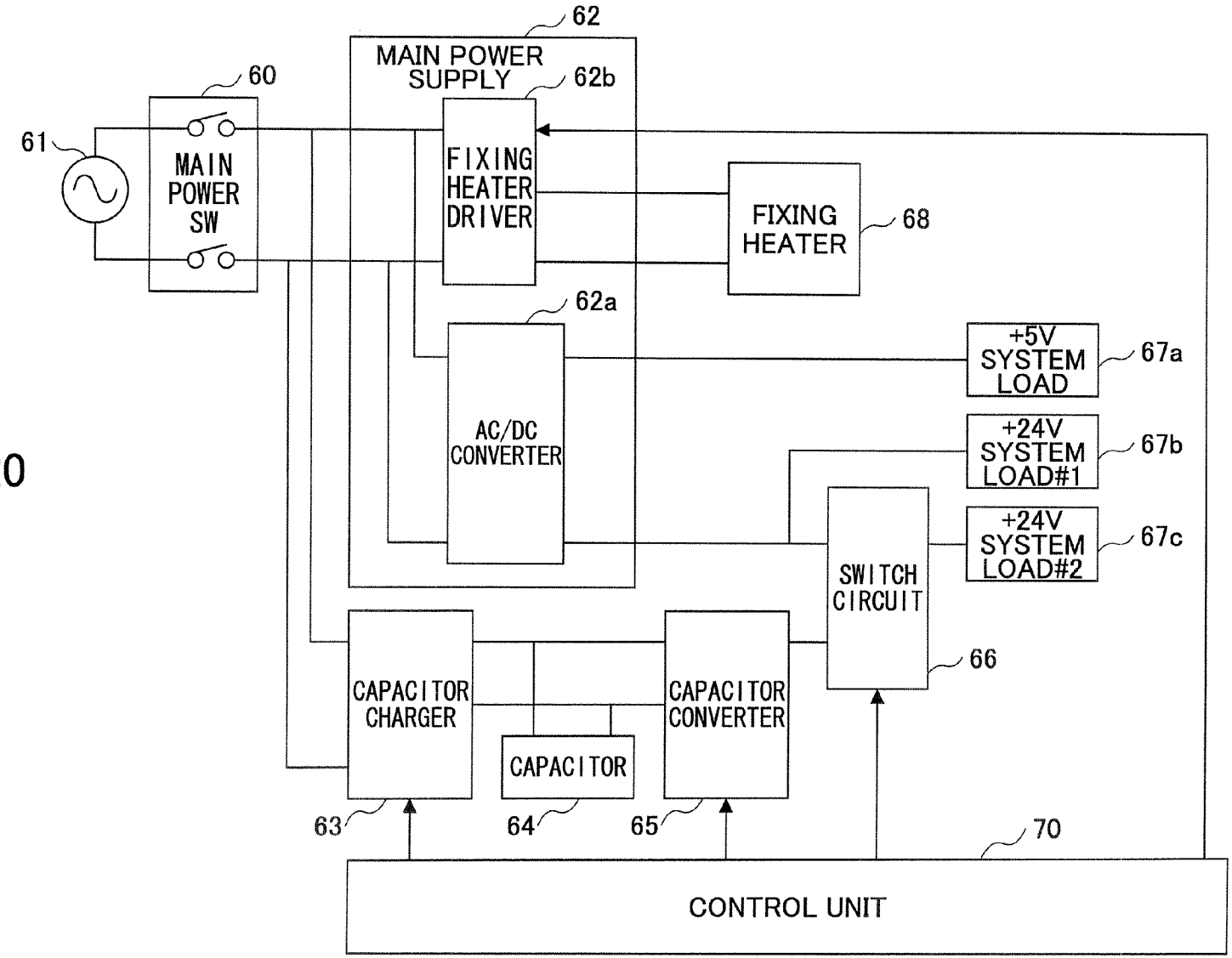
FIG. 20 is a block diagram showing the composition of a power supplying part of the image forming device of FIG. 19.

FIG. 20 shows the composition of a power supplying part of the image forming device of FIG. 19.

The power supplying part of the image forming device of FIG. 19 is connected to the AC power supply 61. The power supplying part comprises a main power switch 60, a main power supply 62, a capacitor charger 63, a capacitor 64, a capacitor converter 65, a switch circuit 66, a +5V system load 67*a*, first and second +24V system loads 67*b* and 67*c*, a fixing heater 68, and a control unit 70.

The main power switch 60 is a switch for turning ON or OFF of the power supply of the image forming device. When the switch 60 is set to ON, the image forming device can receive the electric power supply from the AC power supply 61.

The main power supply 62 is a unit for supplying electric power to respective parts which perform the functions of the image forming device, and it has an AC/DC converter 62*a* and a fixing heater driver 62*b*.

The AC/DC converter 62*a* is a unit for transforming the AC power supplied from the AC power supply 61, into DC electric power. The generated DC electric power is supplied to each DC load by the AC/DC converter 62*a*.

The fixing heater driver 62*b* is a circuit for driving the fixing heater 68. The capacitor charger 63 is a circuit which transforms the AC power supplied from the AC power supply 61, into DC electric power, and charges the generated DC electric power to the capacitor 64.

The capacitor 64 is an auxiliary power supply of the image forming device and has a large capacitance. The capacitor 64 is, for example, an electric double layer capacitor.

Although another capacitor than an electric double layer capacitor may also be used as the auxiliary power supply, the electric double layer capacitor is used in this embodiment, which allows the charge and discharge in a short time and has a long life.

The capacitor converter 65 is a unit for adjusting the voltage so that the voltage discharged from the capacitor 64 may become fixed. Since the electric double layer capacitor used as the capacitor 64 has such a feature that the voltage between the terminals becomes low as the capacitor is discharged, it is necessary to provide the capacitor converter 65 at the position following the capacitor 64, to set the output of the capacitor 64 at a fixed voltage.

Any of a voltage-raising converter, a voltage-lowering converter or a voltage raising/lowering converter may be used as the capacitor converter 65 according to the charge voltage and use minimum voltage specification of the capacitor.

The switch circuit 66 is a unit for changing the electric power supplied to the second +24V system load 67*c*, to one of the DC electric power generated from the AC power, supplied from the AC power supply 61, by the AC/DC converter 62*a*, and the DC electric power supplied via the capacitor converter 65 from the electric power charged by the capacitor 64.

The +5V system load 67*a* and the first and second +24V system loads 67*b* and 67*c* are DC loads, and these loads are used to drive the image forming device by 5V or 24V and perform the function of the image forming device.

The fixing heater 68 is a unit for heating the fixing device 114 of FIG. 19. The fixing heater 68 in this embodiment is an AC load driven with AC power.

The control unit 70 controls the whole image forming device and also controls operation of each of the fixing heater driver 62*b*, the capacitor charger 63, the capacitor converter 65, and the switch circuit 66.

Next, operation of the power supplying part shown in FIG. 20 will be explained.

When the main power switch 60 is set to ON, the AC power is supplied to the main power supply 62 and the capacitor charger 63 from the AC power supply 61.

A part of the AC power supplied to the main power supply 62 is transformed into DC electric power by the AC/DC converter 62*a* of the main power supply 62.

The generated DC electric power is directly supplied to the +5V system load 67*a* and the first +24V system load 67*b*, and it is supplied via the switch circuit 66 to the second +24V system load 67*c*.

The remaining AC power supplied to the main power supply 62 is supplied to the fixing heater 68 via the fixing heater driver 62*b*.

On the other hand, the AC power supplied to the capacitor charger 63 is transformed into DC electric power by the capacitor charger 63. The generated DC electric power is charged by the capacitor 64.

According to each operation mode of the image forming device which is the digital multi-function peripheral, the control unit 70 starts operations of the DC loads 67*a*, 67*b*, and 67*c* sequentially.

The control unit 70 controls the charge and discharge of the capacitor 64 by controlling the capacitor charger 63 and the capacitor converter 65. Upon starting of the image forming device or in the period from the start time to the time a predetermined time has elapsed, the control operation is carried out so that the electric power stored in the capacitor 64 may be discharged.

The electric power of the capacitor 64 is adjusted by the capacitor converter 65 so that it may become a desired voltage value (in this embodiment, +24V). At this time, the control unit 70 controls the switch circuit 66 so that the electric power of the capacitor 64 is supplied to the second +24V load.

By supplying electric power to the second +24V load from the capacitor 64, a certain amount of margin is produced in the supply capability of the AC power supply 61.

The fixing heater driver 62*b* is controlled by the control unit 70, so that the electric power of this margin is added to the electric power supplied to the fixing heater 68. As a result, the electric power supplied to the fixing heater 68 can be increased.

Figure 21:
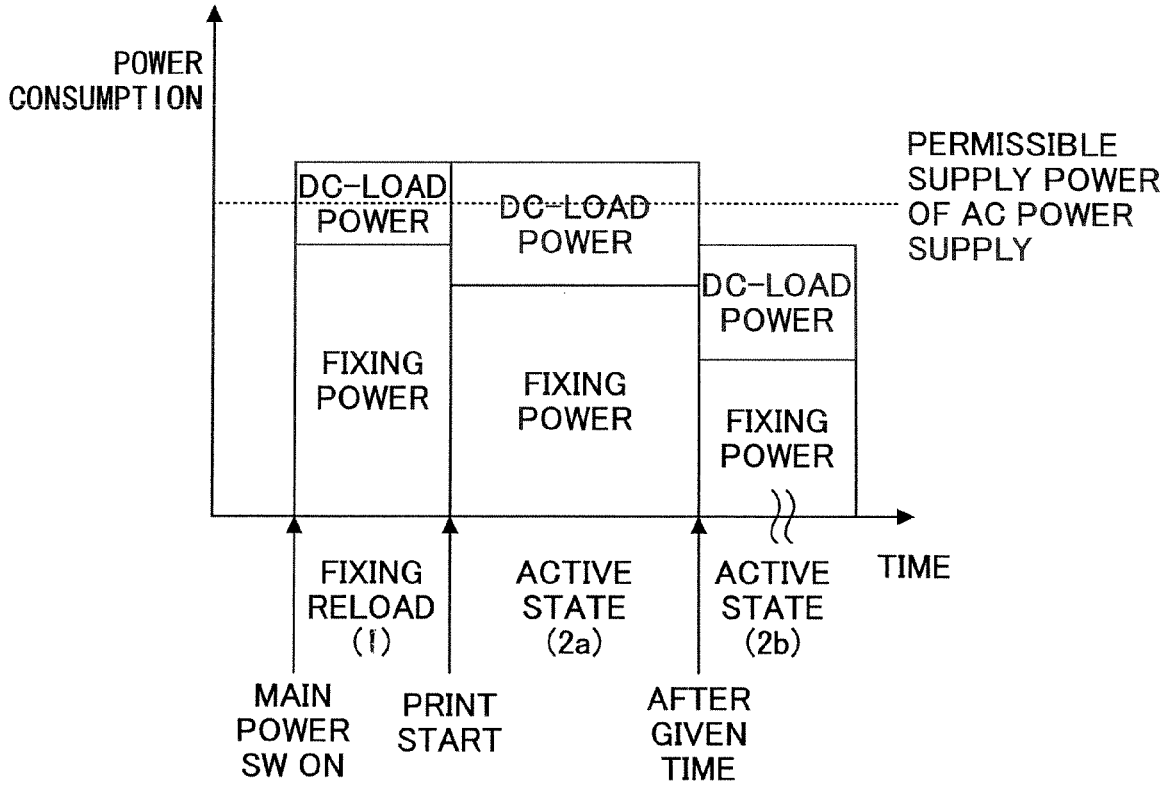
FIG. 21 is a diagram for explaining changes of the power consumption of the image forming device at the time of starting of the image forming device of FIG. 19.

FIG. 21 is a diagram for explaining changes of the power consumption at the time of starting of the image forming device of FIG. 19.

In FIG. 21, time is shown on the horizontal axis and the power consumption of the image forming device is shown on the vertical axis. The dotted line in FIG. 21 indicates the permissible supply power which can be supplied by the AC power supply.

In FIG. 21, it is supposed that the fixing reload period (1) denotes the warm-up period until print operation is started immediately after the main power switch is set to ON, the first active period (2*a*) denotes the period until a predetermined time has elapsed from the print operation start time after the fixing reload period, and the second active period (2*b*) denotes the period until a predetermined time has elapsed after the first active period (2*a*).

In this case, the print operation means the operation in which the toner image transferred to the sheet is fixed by the fixing device 114 of FIG. 19 and then the sheet is ejected. The predetermined time means the time during which the DC load is increasing transitionally from the start time of the print operation.

Figure 2:
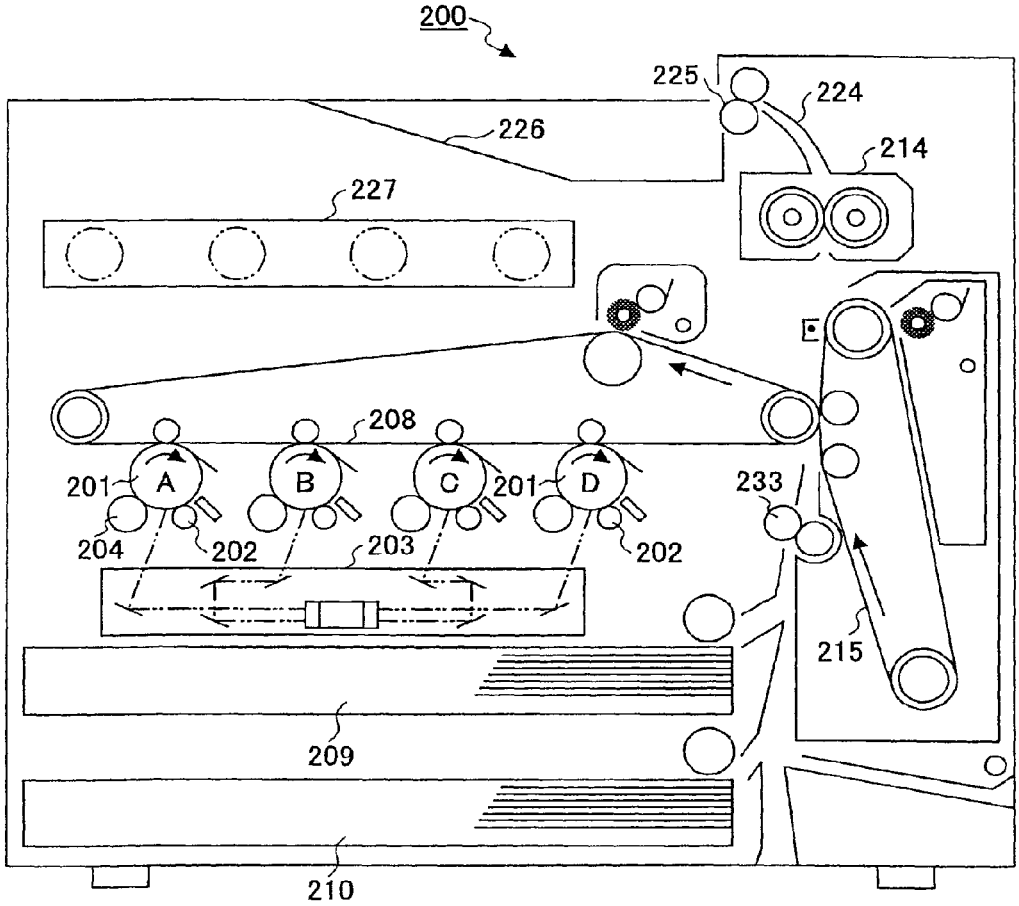
FIG. 2 is a diagram showing the mechanism of a printer of the multi-function peripheral.

In the fixing reload period (1), in order to satisfy the starting time required of the image forming device, it is necessary to supply electric power, which is larger than at the time of the stable active condition, to the fixing heater 68 of FIG. 2, and to heat the fixing device as soon as possible to the temperature which allows the print operation.

Therefore, the fixing electric power which is the electric power supplied to the fixing heater is increased as shown in FIG. 21, but this increased power must satisfy the requirement that the power consumption of the image forming device including the electric power used by the DC load does not exceed the permissible AC power supply.

In the first active period (2*a*), since the temperature of the fixing device reaches the temperature which allows the print operation, the fixing electric power for maintaining the temperature is smaller than that in the period (1).

However, in the period (2*a*), since the print operation is started, the DC load is increased from that in the period (1) due to the starting of the motor etc., and the power consumption of the DC load is also increased.

The image forming device must be designed so that the power consumption which is the total of the fixing electric power and the power consumption of the DC load may not exceed the permissible supply power of the AC power supply.

The second active period (2*b*) is the active condition stabilized mostly. In this period, since each load of the image forming device is in a steady state and a steep change is not produced, the power consumption of the image forming device is fully less than the permissible supply power of the AC power supply.

When the image forming device consumes electric power as mentioned above, the electric power supply of the auxiliary power supply (i.e., the electric power supply of the capacitor 64 of FIG. 2) will be explained for each period.

In the fixing reload period (1), when it is going to shorten the starting time of the image forming device further, it is necessary to increase fixing electric power further.

However, when the power consumption of the image forming device exceeds the electric power of AC power supply shown by the dotted line which can be supplied as a result of the increase of fixing electric power, below the electric power that can supply the supply capability of AC power supply becomes, and the breakdown of a system will be caused.

The power supply source to second +24V system load 67*c* that is a part of DC load is changed to capacitor 64 which is the auxiliary power supply, and a part for the margin to the electric power of AC power supply 61 generated by change which can be supplied to the fixing heater 68.

Therefore, it is possible to shorten the starting time further, without ruining a system. In the first active period (2*a*), as mentioned above, a DC load increases by starting of a motor etc.

Essentially, an image forming device must be designed correspond to increase of this transitional DC load. However, the power consumption of an image forming device may exceed the electric power of AC power supply shown by the dotted line which can be supplied as a result of increase of a DC load. In that case, below the electric power that can supply the supply capability of AC power supply becomes, and the breakdown of a system will be caused.

The power supply source to second +24V system load 67*c* that is a part of DC load is changed to capacitor 64 which is the auxiliary power supply like the period (1), and a part for the margin to the electric power of AC power supply 61 generated by change which can be supplied is supplied to the fixing heater 68. Therefore, it becomes possible to avoid the breakdown of the system.

Moreover, the power consumption of the image forming device in the second period (2*b*) is fully less than the electric power which can be supplied by the AC power supply, and it is not necessary to use the capacitor 64 as the auxiliary power supply like in the periods (1) and (2*a*).

The electric power which can be stored in the capacitor 64 is limited, and it is impossible to perform the electric power supply to the DC load continuously. Therefore, the power supply source of DC load 67*c* is changed from the capacitor 64 to the main power supply 62, and the capacitor 64 is charged through the capacitor charger 63 with the power supply from the AC power supply.

In explanation of the supply timing of the auxiliary power supply, the fixing reload period (1) and the first active period (2*a*) of FIG. 21 are described individually, respectively. However, electric power may be supplied to the DC load from the auxiliary power supply through both the periods.

When electric power is supplied to the DC load from the auxiliary power supply during the fixing reload (1), the temperature fall of the fixing device produced at the time of print operation needed to be expected, and the fixing device needed to be heated to a desired temperature.

However, when it continues during the fixing reload (1) and the first active period (2*a*) also supplies electric power to a DC load from the auxiliary power supply, it is possible to suppress the temperature fall of the fixing device at the time of a print operation start, and the cooking temperature of the fixing device in a fixing reload period (1) can be set up lower.

Figure 22:
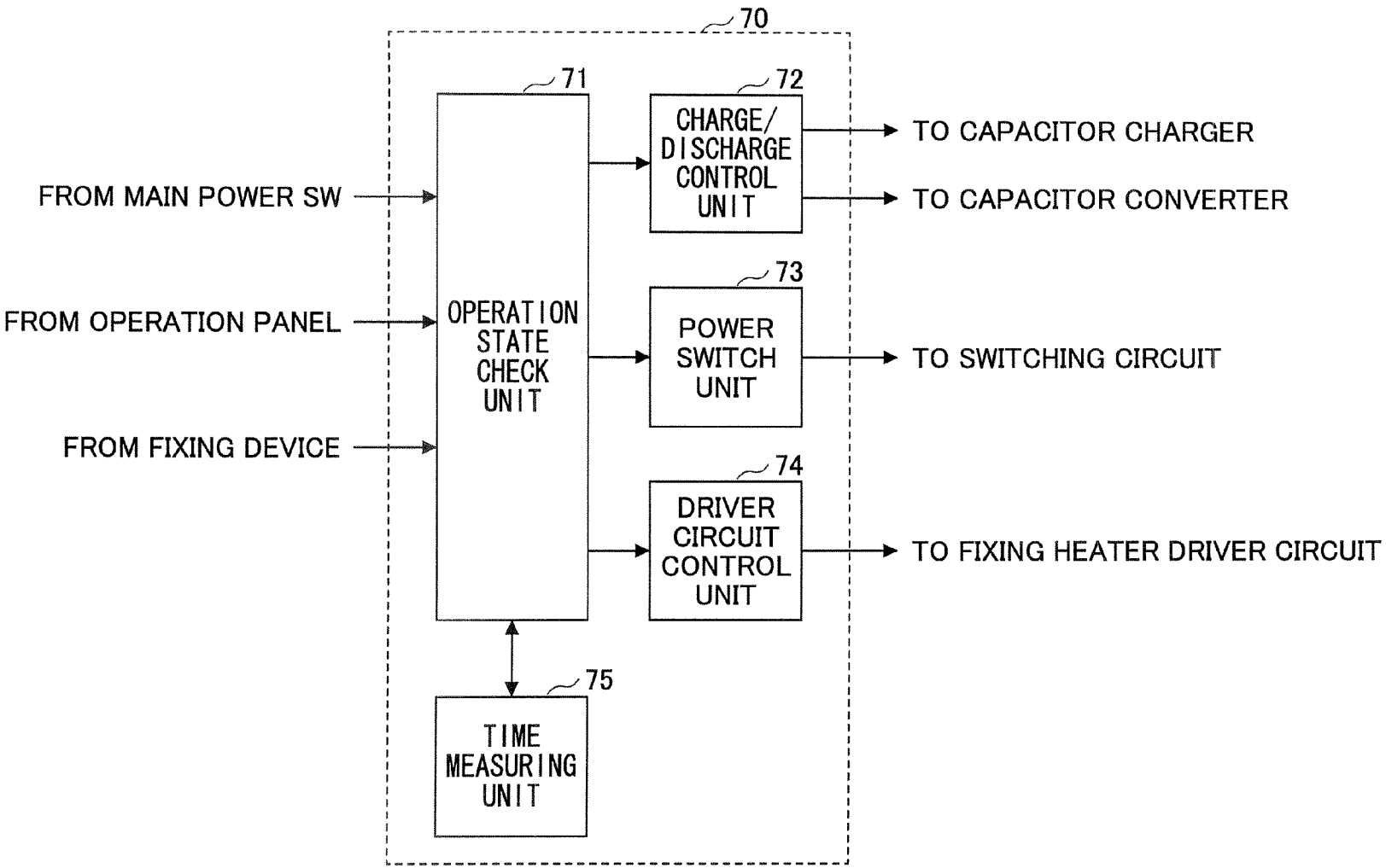
FIG. 22 is a block diagram showing the functions of a control unit in the power supplying part of FIG. 20.

The control of the electric power supply by the control unit 70 of FIG. 20 in this case will be explained with reference to FIGS. 22 and 23. FIG. 22 shows the functional composition of the control unit 70 in the power supplying part of FIG. 20.

As shown in FIG. 22, the control unit 70 is provided to control the whole image forming device. The control unit 70 comprises an operating state check unit 71, a charge/discharge control unit 72, a power supply switching unit 73, a driver control unit 74, and a time measuring unit 75.

The operating state check unit 71 is provided to check the operating state of the image forming device, monitors the state of the main power switch, the fixing device, etc., and receives the incoming signal from a control unit.

The charge/discharge control unit 72 is a unit to control capacitor charger 63 and capacitor converter 65 to carry out charge and discharge of the capacitor 64 of FIG. 20.

The power supply switching unit 73 is a unit which causes the switch circuit 66 of FIG. 20 to be switched on or off. For example, the predetermined period after (a) power-up or return from a low-power mode, (b) change the second power supply source of +24V system load 67*c* from main power supply 62 to the auxiliary power supply 64 at a fixing reload period, the predetermined period after the termination of (c) fixing reload period or (d) fixing reload period, and the predetermined period after the end of the fixing reload period.

The driver control unit 74 is a unit to control the fixing heater driver 62*b* of FIG. 20, and, thereby, fixing electric power is changed by each active period. The time measuring unit 75 is a unit which measures the time progress from the printer start time.

Figure 23:
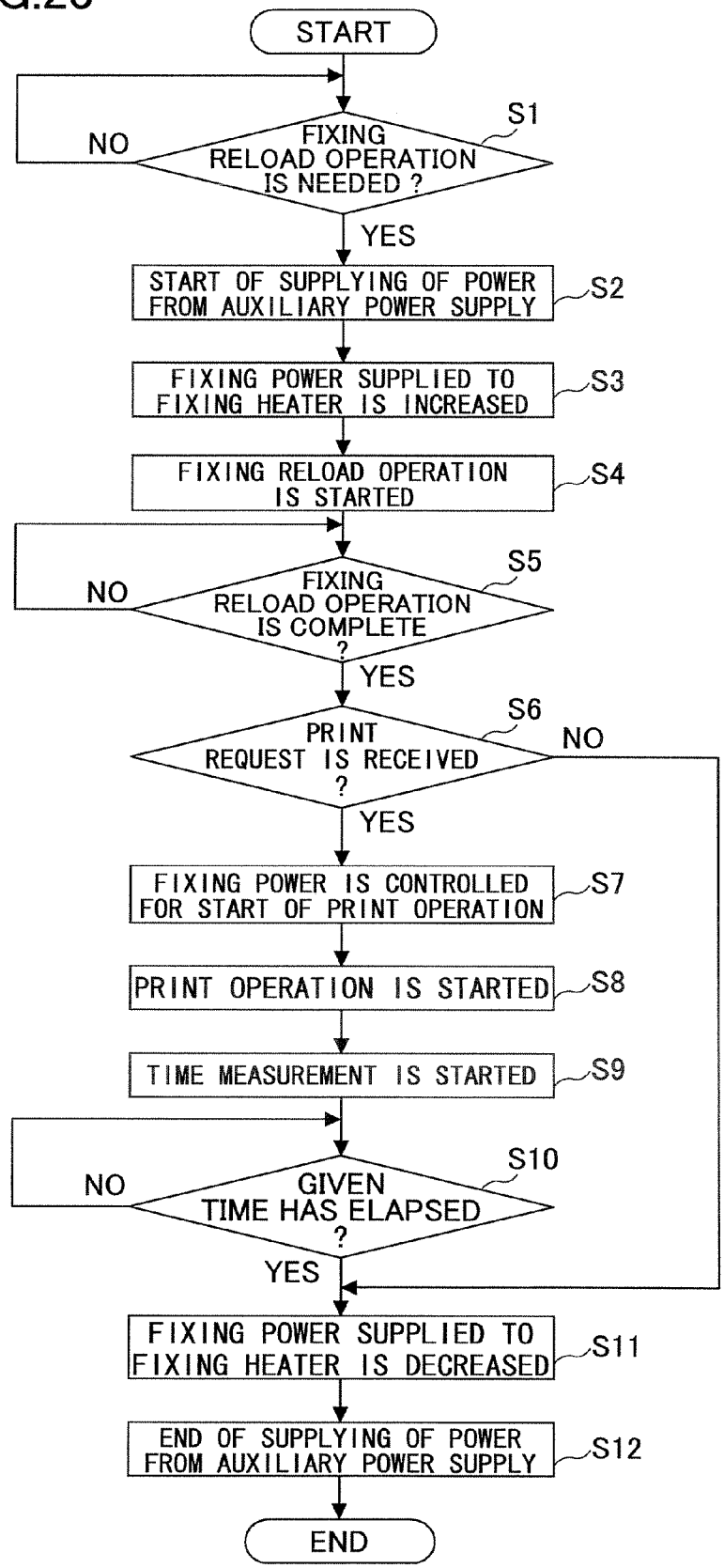
FIG. 23 is a flowchart for explaining control of electric power supply which is performed by the control unit in the power supplying part of FIG. 20.

FIG. 23 is a flowchart for explaining control of the electric power supply by the control unit 70 of FIG. 20.

As for the injection direct rear stirrup of the main power switch, operating state check unit 71 checks the operating state of an image forming device in step S1 at the time of a return from low-power mode.

When it is determined in step S1 that it is necessary to perform fixing reload operation (namely, preparatory operation for fixing of the toner image transferred to the sheet by the fixing device 114 of FIG. 19), the control is shifted to step S2.

The charge/discharge control unit 72 controls the capacitor charger 63 and the capacitor converter 65, and the power supply switching unit 73 controls the switch circuit 66, respectively so that the electric power supply from the capacitor 64 to the second +24V system load 67*c* is started.

Next, in step S3, the driver control unit 74 adds the electric power of the margin of the supply capability of the AC power supply, produced as a result of the operation of step S2, to the electric power supplied to the fixing heater 68, and controls the fixing heater driver 62*b* to increase the electric power supply to the fixing heater 68.

After the operation of step S3, the fixing device starts the fixing reload operation in step S4. The operating state check unit 71 in step S5 determines whether the fixing reload operation is completed. When it is determined that the operation is completed, it is further determined in step S6 whether the print request by the operator is received.

When the print request is received and the electric power supplied to the fixing heater which during the fixing reload operation needs to be changed to the electric power required at the time of the fixing operation (that is, when there is the necessity to change the fixing electric power of the period (1) of FIG. 21 to the fixing electric power of the period (2*a*)), the driver control unit 74 in step S7 controls the fixing heater driver 62*b* so that the electric power is changed in such a manner. At this time, the switch circuit 66 is set so that the electric power of the capacitor 64 is supplied to the second +24V system load 67*c*.

Next, the fixing device starts the print operation in step S8. After a print operation start, the time measuring unit 75 starts time measurement in step S9, and it is detected in step S10 whether a predetermined time has elapsed.

When the predetermined time has elapsed, the fixing driver control unit 74 in step S11 controls the fixing heater driver 62*b* to change the electric power to the fixing heater currently supplied during fixing to the electric power usually required at the time of print operation (that is, the fixing electric power of the period (2*a*) of FIG. 21 is changed to the fixing electric power of the period (2*b*)).

Next, in step S12, the power supply switching unit 73 changes the switch circuit 66, so that the power supply source of the second +24V system load 67*c* is changed from the capacitor 64 to the AC/DC converter 62*a* of the main power supply. At this time, the capacitor converter 65 is stopped by the charge/discharge control unit 72.

After the fixing reload operation, when it is determined in step S6 that there is no print request continuously, the control is shifted to the step S11, and the control unit 70 performs the control operation so that the electric power supply operation of the capacitor 64 is suspended.

In explanation of the supply timing of the auxiliary power supply, the period (namely, first active period (2*a*)) while the DC load is increasing transitionally after the fixing reload period (1) considered for large electric power to be required at the fixing heater and a fixing reload period is described.

However, even if it is periods other than these, it is possible to apply the same operation to the fixing heater, if it is the period which needs large electric power and which is specified.

For example, since the temperature of an the fixing device will fall by the sheet supplying if print operation is started after a fixing reload period, the electric power to the fixing heater is applicable also to the system which needs to increase.

In this case, the period specified is essentially the same as the period until it finishes printing predetermined number of sheets, and if it considers it as the variable value which made a paper size, room temperature, etc. the parameter, it can make the most of the capacity of a capacitor.

In the above-mentioned embodiment, the load to which electric power is supplied from capacitor 64 as the auxiliary power supply is second +24V system load 67*c* that is a part of DC load.

However, as long as it is a DC load, it may be other loads and may be made for electric power to supply all the DC loads from the auxiliary power supply. The electric power supply to AC load also becomes possible by forming a DC/AC converter after capacitor 64.

The capacitor charger 63 in front of capacitor 64 consisted of embodiments mentioned above so that it might connect with AC power supply 61 directly. However, it may be provided after AC/DC converter 62*a* of a main power supply part. In that case, the capacitor charger does not need to have a function of AC/DC conversion.

In the above-mentioned embodiment, the fixing heater 68 is the AC load driven with the AC power.

However, it may be a DC load driven with DC electric power, such as IH (induction heating) fixing. In this case, it changes that fixing heater driver 62*b* which drives the fixing heater 68 has an AC/DC converter etc., and DC electric power needs to be supplied to the fixing heater 68.

The capacitor unit (namely, capacitor charger 63, capacitor 64, and capacitor converter 65 of FIG. 20) of FIG. 19 or all may be provided in the exterior of the image forming device concerned.

The AC power is the commercial power, for example, AC 100V/50 Hz (or 100V/60 Hz). The DC electric power is the direct current power, for example, +24V and +5V.

The DC electric power is obtained by the switching regulator. The capacitor power supply unit which used the capacitor is used for the auxiliary power supply. A microprocessor is used for a control unit.

In an embodiment of the invention which solves or reduces one or more of the above-mentioned problems, there is provided an image forming device comprising: a power supply part supplying AC power and DC power to a load of the image forming device; a capacitor storing DC power therein and discharging the stored DC power to the load; and a control unit adapted to control the power supply part and the capacitor so that the DC power stored in the capacitor is supplied to the load during a predetermined period after power-up of the image forming device or return from a low-power mode occurs.

According to this image forming device, the DC power can be supplied to the DC load by the auxiliary power supply which is the capacitor, and it is possible to keep the power consumption of the image forming device from exceeding the permissible electric power capacity even if a steep change of the load occurs. Although the supplying of DC power to the load by the capacitor is performed for the predetermined period, the predetermined period is calculated beforehand by determining the required amount of auxiliary electric power and determining the capacity of the capacitor according to the required amount of auxiliary electric power. Thus, the auxiliary power supply can be constructed with a simple structure and efficiently used in the image forming device.

The above-mentioned image forming device may be configured so that the control unit is adapted to control the power supply part and the capacitor so that the DC power stored in the capacitor is supplied to the load during a fixing reload period of the image forming device.

According to this image forming device, it is possible to supply a part of the DC power corresponding to a margin to the maximum supply capability of the AC power line to a fixing heater, and the time for starting of the image forming device can be shortened.

The fixing reload period is, for example, a period between a time the main power switch of the image forming device is set to ON and a time a print operation of the image forming device is started.

The above-mentioned image forming device may be configured so that the control unit is adapted to control the power supply part and the capacitor so that the DC power stored in the capacitor is supplied to the load during a predetermined period after an end of a fixing reload period of the image forming device.

According to this image forming device, it is possible to supply a part of the DC power corresponding to a margin to the maximum supply capability of the AC power line to a fixing heater, thereby preventing the fall of the fixing temperature due to the sheet transport.

The above-mentioned image forming device may be configured so that the control unit is adapted to control the power supply part and the capacitor so that the DC power stored in the capacitor is supplied to the load during a fixing reload period of the image forming device and during a predetermined period after an end of the fixing reload period.

According to this image forming device, it is possible to suppress a temperature fall at the time of a print start and set up the reload temperature low, thereby further shortening the time for starting of the image forming device.

Figure 1:
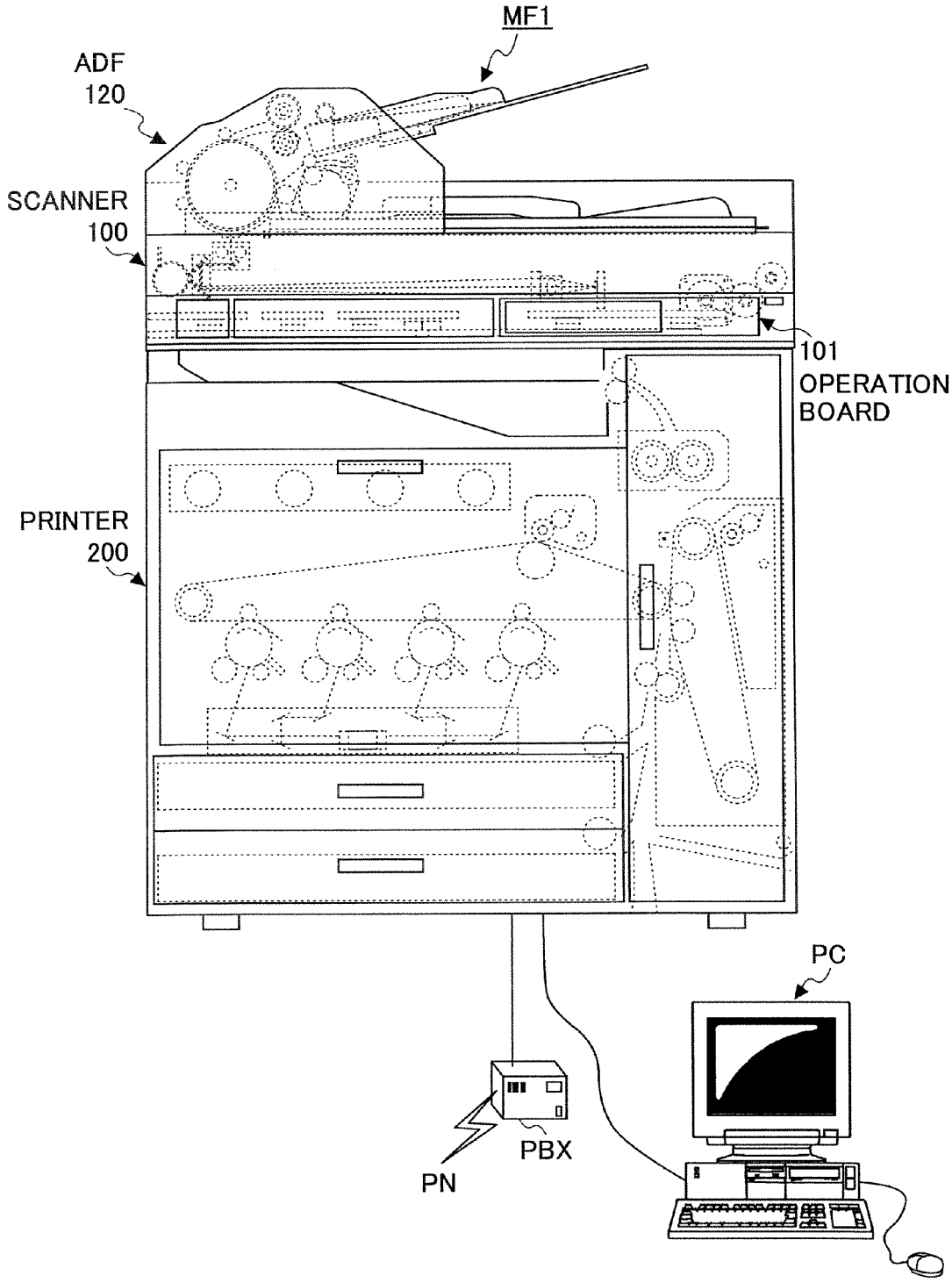
FIG. 1 is a diagram showing the composition of a full-color digital multi-function peripheral in an embodiment of the invention.

FIG. 1 shows the composition of a full-color digital multi-function peripheral MF1 in an embodiment of the invention.

As shown in FIG. 1, this full color multi-function peripheral MF1 generally includes an automatic document feeder (ADF) 120, an operation board 101, a color scanner 100, and respective units of the color printer 200.

Figure 3:
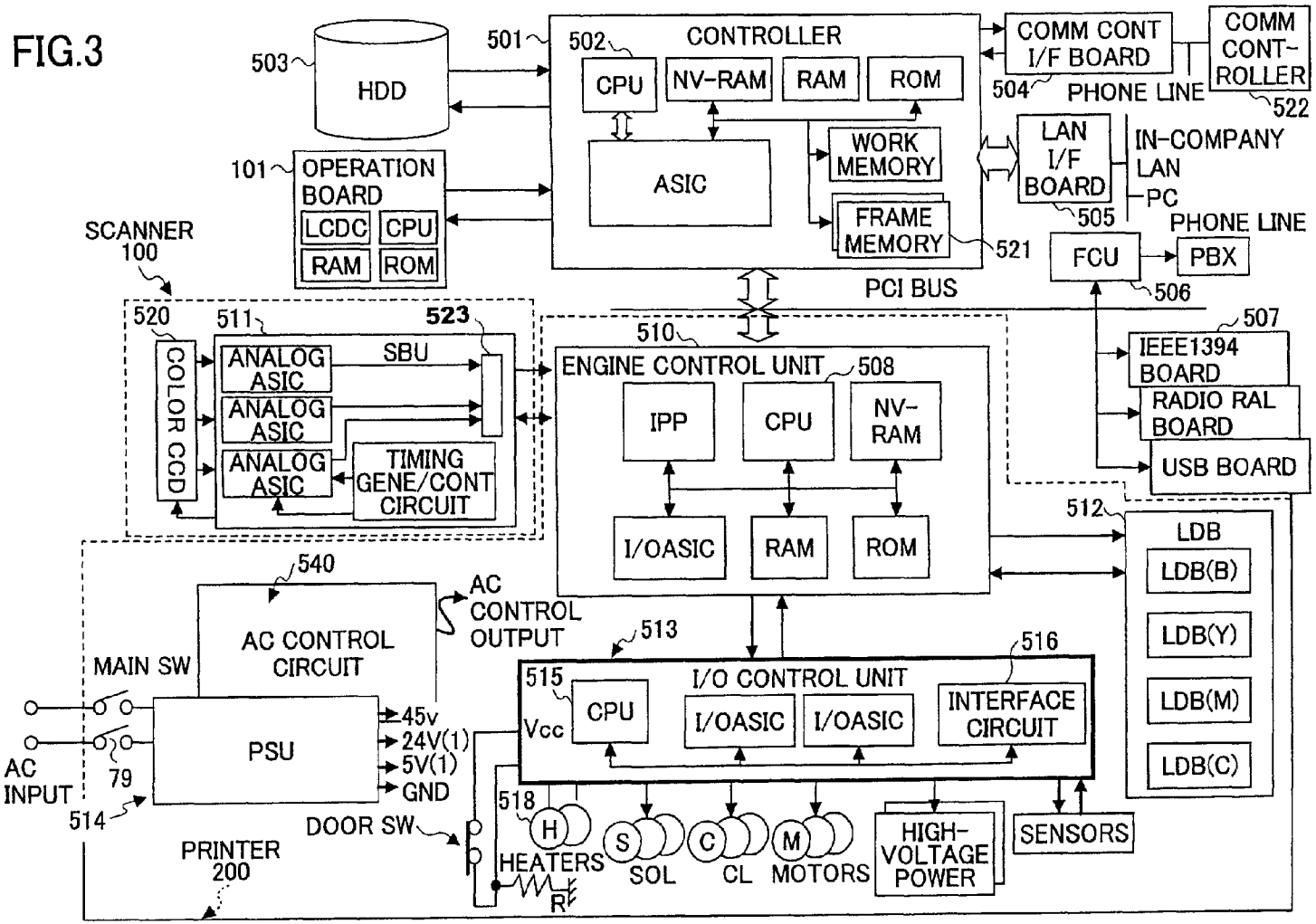
FIG. 3 is a block diagram showing the composition of an electric power system of the multi-function peripheral of FIG. 1.

The operation board 101 and the color scanner 100 with ADF 120 are detachable from the printer 200. The color scanner 100 has a control board which has a power device driver, and a sensor input and a controller, and it communicates with an engine controller (the CPU 508: FIG. 3) directly or indirectly, timing control is carried out, and a document image is read.

The controller board (501: FIG. 3) to which the scanner 100, the printer 200, and the engine (510: FIG. 3) are connected is connected to LAN (Local Area Network) in which a personal computer PC is connected. The exchanger PBX connected to telephone line PN (facsimile communication circuit) is connected to the facsimile control unit (FCU 506: FIG. 3).

The mechanism of color printer 200 of the multi-function peripheral MF1 is shown in FIG. 2.

The color printer 200 of this embodiment is a laser printer. The four sets of toner image formation units a-d for this laser printer 200 to form the image of each color of magenta (M), cyan (C), yellow (Y), and black (K) are arranged in this order along the feed direction of the 1st transfer belt 208 (the direction y from the left to the right in FIG. 2).

That is, this color printer 200 is a full color image forming device of 4 color drum system (tandem system).

The electric discharger, the cleaning device, the charging unit 202, and the developing unit 204 are arranged at the peripheral part of the photoconductor 201 which is supported pivotably and rotates in the direction of the arrow.

Between the charging unit 202 and the developing unit 204, the space containing the optical information emitted from the optical writing unit 203 is secured. Although the number of the photoconductors 201 is four, the parts constitution for image formation provided in the circumference, respectively is the same composition as the above-mentioned one.

The color of the color material (toner) used by the developing unit 204 is different. Some each the photoconductor 201 (four pieces) is in contact with the 1st transfer belt 208.

Although this embodiment is explained by the case where the photoconductor is cylindrical, the invention is not limited to this embodiment and a belt-like photoconductor may be used instead.

The 1st transfer belt 208 is supported and laid firmly by the arrow y direction possible transport between the rotating support roller and the driving roller, and the 1st transfer roller is arranged near the photoconductor 201 on the back surface (the inside of the loop) of the 1st transfer belt 208, respectively.

The cleaning device for 1st transfer belt 208 is arranged on the outside of the belt loop. A cleaning device wipes away the unnecessary toner which remains on the surface, after transferring a toner image from the 1st transfer belt 208 to a plain paper (sheet) or the 2nd transfer belt.

The optical writing unit 203 includes a known laser system, and irradiates, with the optical information corresponding to full color image formation, the surface of the photoconductor 201 charged uniformly as a latent image.

Although the case where the optical writing unit is a laser system has been described, the invention is not limited to this embodiment. It may adopt the optical writing unit which includes an LED array and an image formation means.

In FIG. 2, the 2nd transfer belt 215 is arranged at the method of the right of the 1st transfer belt 208. The 1st transfer belt 208 and the 2nd transfer belt 215 contact, and form the transfer NIP defined beforehand. The 2nd transfer belt 215 is supported and laid firmly between the support roller and the driving roller possible transport in the direction of the arrow, and the 2nd transfer means is arranged on the background (inside of a loop) of the 2nd transfer belt 215.

The cleaning device for the 2nd transfer belt, the charger, etc. are arranged on the outside of the belt loop of the 2nd transfer belt 215. This cleaning device wipes away the unnecessary toner which remains, after transferring toner in a form.

The plain paper (sheet) is contained in the sheet paper cassettes 209 and 210 of the lower part of a figure, and the best form is conveyed by the resist roller 233 through two or more one-sheet form guides of every with a feed roller. Above the 2nd transfer belt 215, the fixing unit 214, transport guide 224, transport roller 225, and transport stack 226 are arranged.

In the upper part of the 1st transfer belt 208, containing section 227 which can store the toner for supply is formed under the transport stack 226. The color of toner has four colors of magenta, cyan, yellow, and black, and supports the form of a cartridge.

The developing unit 204 of a color which corresponds with a toner from each cartridge is supplied suitably. Operation of each part at the time of the double-side printing in the image forming device shown in FIG. 2 will be explained.

Imaging by the photoconductors 201*a*-201*d* is performed first. That is, pass the optical component whose light from non-illustrated LD luminous source is not illustrated by the operation of the optical writing unit 203, it results on the photoconductor of imaging unit a among the photoconductors 201 uniformly charged with the charging unit 202, and the latent image corresponding to the writing information (information according to the color) is formed.

The latent image on the photoconductor 201 is developed with the developing unit 204, and the visual image by toner is formed in the surface of the photoconductor 201, and it is held.

This toner image is transferred by the surface of the 1st transfer belt 208 sent by the 1st transfer means synchronizing with the photoconductor 201. The toner which remains is cleaned with a cleaning device, is discharged with an electric discharger, and equips the following imaging cycle with the surface of the photoconductor 201.

The 1st transfer belt 208 supports the toner image transferred by the surface, and is sent in the direction of the arrow.

The latent image corresponding to another color is written in the photoconductor 201 of imaging unit b, negatives are developed with the corresponding toner of a color, and it becomes a visual image. It puts on the visual image of the color before having already ridden on the 1st transfer belt 208 and, finally the visual images of the four colors are overlaid.

There may be the case in which only a monochrome black image is formed. In synchronism at this time, the 2nd transfer belt 215 is sent in the direction of the arrow, and the image which is the action of the 2nd transfer means and is made by the 1st transfer belt 208 surface on the surface of the 2nd transfer belt 215 is transferred.

Since the 1st transfer belt 208 and the 2nd transfer belt 215 are sent and imaging is advanced while the image is formed on each the photoconductor 201 of the four imaging unit a-d which is what is called tandem form, the time can be shortened.

If the 1st transfer belt 208 is sent to a predetermined transport position, the toner image which should be created by another surface of the sheet will be again formed with the photoconductor 201 at a process which is mentioned above, and feeding will be started.

The sheet at the uppermost part in sheet paper cassette 209 or sheet paper cassette 210 is pulled out, and it is conveyed by resist roller 233.

The toner image of the 1st transfer belt 208 surface is transferred by the surface of one side of the sheet conveyed between the 1st transfer belt 208 and the 2nd transfer belt 215 by the 2nd transfer means through resist roller 233.

A recording medium is conveyed up and the toner image of the 2nd transfer belt 215 surface is transferred by another surface of a sheet by a charger. When transferring, timing is taken and a sheet is conveyed so that the position of the image may become regular.

The sheet on which the toner image is transferred by both sides at the above step is sent to the fixing unit 214, the toner image on a sheet (both sides) be established and pass guide 224, it is discharged by the transport stack 226 of the body frame upper part with transport roller 225.

Since the surface transferred by the sheet (page), i.e., the surface by which direct transfer is carried out to a sheet from the 1st transfer belt 208, turns into the undersurface afterwards among double-sided images and it is laid in transport stack 226, when sheet ejection parts 224-226 are constituted as shown in FIG. 2.

The 2nd page image is created previously to the toner image is held to the 2nd transfer belt 215, and direct transfer of the 1st page image is carried out to the sheet from the 1st transfer belt 208.

The image directly transferred by the sheet turns into a normal image from the 1st transfer belt 208 on the photoconductor surface, and the toner image transferred by the sheet from the 2nd transfer belt 215 is exposed so that it may become a reverse image (image of a sound source) on the photoconductor surface.

The read/write control of the image data to the memory on the controller 501 is also performing image processing switched to the order of imaging and a normal image, and a reverse image (image of a sound source).

After transferring in a sheet from the 2nd transfer belt 215, the cleaning device provided with the brush roller, the recovery roller, the blade, etc. removes unnecessary toner and the edge dust which remain to the 2nd transfer belt 215.

It is in the state where the brush roller of the cleaning device of the 2nd transfer belt 215 separated from the surface of the 2nd transfer belt 215, in FIG. 2.

In the fulcrum, the brush roller is rockable as a center, and has a structure removable on the surface of the 2nd transfer belt 215. It detaches, while the 2nd transfer belt 215 is supporting the toner image, and when cleaning is necessity, it rocks counterclockwise by a diagram and is made to contact, before transferring in a sheet.

The removed unnecessary toner is brought together in a toner compartment. The above is an imaging process in the double-side printing mode which set up the double-sided transfer mode.

In the case of double-side printing, printing is always performed in this imaging process. In the case of single side printing, there are the two modes in the one side transfer mode by the 2nd transfer belt 215 and the one side transfer mode by the 1st transfer belt 208.

When the one side transfer mode using the former 2nd transfer belt 215 is set up, the visual image formed in the 1st transfer belt 208 by three colors, 4 color piles, or monochrome black is transferred by the 2nd transfer belt 215, and is transferred by one side of the sheet.

In this case, a printing screen is located on the upper surface of the printed sheet discharged by transport stack 226.

When the one side transfer mode using the latter 1st transfer belt 208 is set up, the visual image formed in the 1st transfer belt 208 by three colors, 4 color piles, or monochrome black is transferred by one side of the sheet, without being transferred by the 2nd transfer belt 215.

In this case, a printing screen is located on the undersurface of the printed sheet discharged by transport stack 226.

FIG. 3 shows the system composition of an electric power system of the multi-function peripheral MF1 of FIG. 1.

The electric power system is provided with the following. The controller 501 performs control of the whole image forming device. The operation board 101 of the image forming device is connected to the system controller 501. The HDD 503 stores image data. The communication controller interface board 504 performs communication with the exterior device using the analog channel. The LAN interface board 505. The FAX control unit 506 is connected to the general-purpose PCI bus. IEEE 1394 board, wireless LAN board, and USB board 507. The engine control unit 510 is connected to the controller by PCI bus. The I/O board 513 which controls I/O of the image forming device is connected to the engine control unit 510. And the electric power system includes the LDB (laser diode board) 512 which irradiates the scanner board (SBU) 511 which reads a copy document (image), and the image light which indicates the image data on the photoconductor drum.

The image scanner 100 which reads the document optically scans the document illumination light source over the document, and carries out image formation of the document image to the CCD 520.

Photoelectric conversion of the reflected light of the optical irradiation to the document image is carried out by the CCD 520, and the R (Red), G (Green) and B (Blue) image signals are generated.

The communication controller interface board 504 is enabled to notify external remote place diagnostic device immediately, when fault occurs to device, and for a serviceman to recognize the contents of the locating fault, a situation, etc., and to fix them immediately.

It is used also for dispatch of the operating condition of device etc. in addition to it. The CCD 520 shown in FIG. 3 is three-line color CCD, generates R of EVENch (even-pixel channel)/ODDch (odd-pixel channel), G, and B image signal, and inputs them into analog ASIC of a SBU board (Application Specific IC).

The SBU board 511 is equipped with the circuit which generates the drive timing of analogs ASIC and CCD and analog ASIC.

The output of the CCD 520 is subjected to sampling and holding by the sample/hold circuit inside the analog ASIC. After the sample/hold is carried out, the A/D conversion is carried out and the resulting signal is converted into the image data of R, G, and B.

And the shading correction is carried out and it sends out to the image-data processing processor IPP (it is only described as IPP below by Image Processing Processor) via an image data bus by output I/F (interface) 523. The IPP is a programmable arithmetic processing means which performs image processing, and performs separation generation (image determination of a character area or a photograph domain: image region separation), natural complexion removal, scanner gamma conversion, a filter, color correction, variable power, image processing, printer gamma conversion, and gradation processing.

The image data transmitted to IPP from SBU have signal degradation (signal degradation of a scanner system) accompanying the quantization to an optical system and a digital signal rectified in IPP, and are written in frame memory 521.

The ROM which performs control of the CPU 502 and a system controller board in system controller 501, the RAM and the lithium cell which are the working-level month memories which the CPU 502 uses are built in.

The ASIC which controls the CPU circumferences, such as NV-RAM which built in backup and the clock of SRAM, and the system bus control of the system controller board, frame memory control, and FIFO, its interface circuit, etc. are carried.

The system controller 501 has the functions of two or more applications, such as scanner application, facsimile application, printer application, and copy application, and controls the whole system.

The input of operation board 101 is decoded and setup and its contents of a state of this system are displayed on the display of operation board 101.

Many units are connected to the PCI bus and image data and control commands are transmitted by time sharing with image data bus/control command bus. The communication controller interface board 504 is a communication interface board of the communication controller and the controller 501. The communication with the controller 501 is established, for example by full duplex asynchronous serial communication.

The multidrop connection is made by RS-485 interface standard practice in the communication controller 522.

Communication with a remote management system is carried out via this communication controller interface board 504. It connects with in-company LAN, and LAN interface board 505 is a communication interface board of in-company LAN and controller 501, and carries the PHY chip.

The LAN interface board 505 and the controller 501 are connected with the standard communication interface of PHY chip I/F and 12 C-bus I/F. Communication of the MFP1 with an external device is carried out via the LAN interface board 505.

The HDD 503 is used as the application database in which the device actuation information concerning the application program and printer of the system and the imaging process unit, and as the image database in which image data of read images or written images and document data are stored. The physical interface and the electric interface are connected to the controller with the interface in conformity with ATA/ATAPI-4.

The ASIC (LCDC) which controls CPU, ROM, RAM, LCD, and the key input is disposed on the operation board 101. The control program of the operation board 101 which controls the input reading and the display outputting of the operation board 101 is stored in the ROM.

The RAM is a work memory used by the CPU. Control of the inputting of the system setting, which is inputted by the user on the operation panel, and the displaying and outputting to display the contents of the system setting and state to the user is performed through the communication between the RAM and the system controller 501.

The write signals of respective colors of black (Bk), cyan (C), magenta (M) and yellow (Y), which are outputted from the work memory of the system controller 501, are inputted to the LD (laser diode) writing circuits of respective colors of Bk, C, M, and Y of the LDB (laser diode control board) 512. The LD current control (modulation control) is performed by each LD writing circuit and the resulting signal is outputted to the LD.

The engine control unit 510 mainly performs imaging control of image formation. In the engine control unit 510, the CPU 508, the IPP for performing image processing, the ROM in which the program for controlling the copy and print functions is stored, the RAM for controlling the program, and the NV-RAM are contained. In the NV-RAM, the SRAM and the memory which stores, when a power-down is detected, the detection result in EEPROM are contained. There is also provided the serial interface which transmits signals to and receives signals from the CPU which performs another control.

The I/O ASIC is an ASIC which controls the I/O hardware (a counter, a fan, a solenoid, a motor, etc.) in the vicinity of the position where the engine control board is mounted. The I/O-hardware control board 513 and the engine control board 510 are connected via the synchronous serial interface.

The sub CPU 515 is disposed on the I/O-hardware control board 513. Digital conversion of the analog signal of the fixing temperature sensor, the output voltage Vco and the capacitor power unit, and the analog signals of the P sensor, the T sensor, etc. is performed and they are read by the sub CPU 515, so that the control of the I/O hardware of the image forming device including the drive of the output device, the jam detection performed by making reference to the sheet sensor, and the sheet transport control is performed.

The interface circuit 516 is an interface circuit which allows the MFP1 to communicate with various sensors and actuators (motors, clutches, solenoids).

Figure 4:
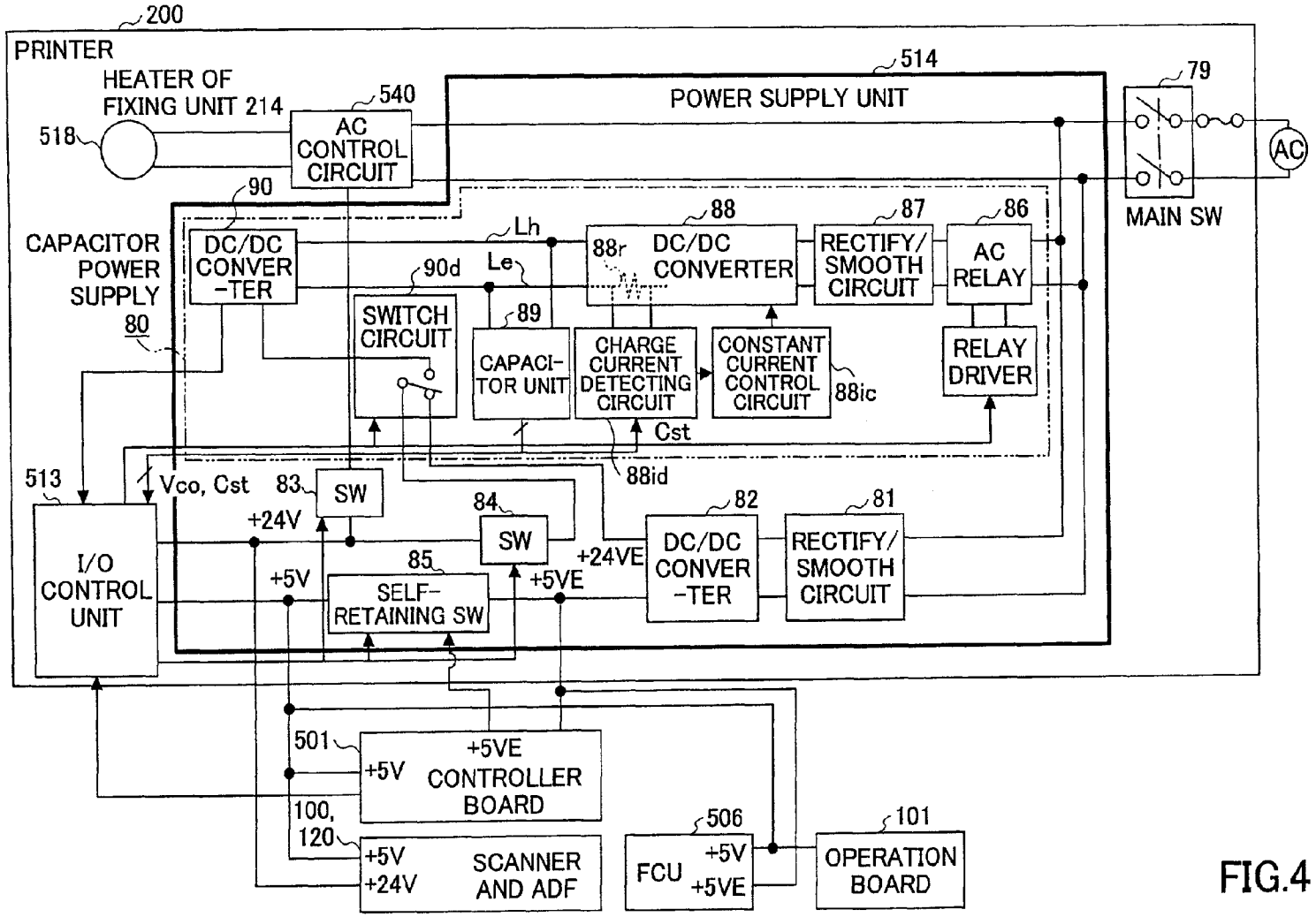
FIG. 4 is a diagram showing the composition of a power supply unit.

The power supply unit PSU 514 is a unit which supplies electric power to control the image forming device. The source power is supplied to the image forming device by turning ON (closed) of the main SW 79 (FIG. 4). The commercial AC is supplied to the AC control circuit 540 from the source power supply, and the AC control circuit 540 supplies AC power to the main heater 518 (FIG. 4) of the fixing device 214.

In the power supply unit (PSU) 514, there are provided the main power supply circuit which supplies direct current voltage to respective parts of the image forming device, and the capacitor power unit 80 (FIG. 4) which is the auxiliary power supply which supplies direct current power to respective parts of the image forming device.

FIG. 4 shows the composition of the power supply unit 514.

When the main SW (the power switch) 79 is closed, the commercial alternating current 100V is supplied to the rectify/smooth circuit 81 and the AC control circuit 540 in the power supply unit 514.

The dc output of the rectify/smooth circuit 81 is applied to the DC-DC converter 82. In this example, the DC-DC converter 82 generates two stable direct-current voltages +24VE and +5VE.

In the power supply unit 514, the switches 84 and 85 are connected to +24VE (stable voltage of +24V) and +5VE (stable voltage of +5V) for the converter output via the connection switch circuit 90*d* of the capacitor power unit 80, respectively.

The AC control circuit 540 is energized to the main heater 518 of the fixing device 214. There is a power supply relay closed by +24V given through the switch 83, and the commercial alternating current AC is applied to the AC energization circuit energized to the main heater 518 in the AC control circuit 540 by closing this power supply relay.

This AC energization circuit is the AC energization circuit of the phase control which uses a phase control switching element, and with reference to the temperature detection signal of the fixing temperature sensor which is read by the I/O hardware control 513, it controls the conduction phase of the switching element so that the fixing temperature turns into the target temperature.

The above-mentioned switch 85 is a self hold switch which is set to ON (conduction) in response to the ON request signal from the CPU 502 of the controller board 501, and performs the self holding of the ON.

When the OFF request signal (reset request signal) from the CPU 508 of the engine control unit 510 is received, the switch 85 is set to OFF (non-conduction), and the self holding of the ON is canceled.

Electric power of +5V outputted by the self hold switch 85 is supplied to the control circuit of each part of the image forming device.

Electric power of +5VE applied to the switch 85 is supplied to the CPU 502 and the circuit which monitors of whether the return conditions to the normal-power mode (standby mode) are satisfied in the energy saving mode (pause mode).

Since the output voltage +5V of the switch 85 is applied to the CPU 508 (and the I/O hardware control 513) of the engine control unit 510, the engine control unit 510 (the CPU 508) and the I/O hardware control 513 start operation, when the switch 85 is turned ON. Energization is performed by the +5V which is outputted by the switch 85, so that the CPU 502 of the controller board 501 returns to the normal-power mode (standby mode) from the energy saving mode (pause mode).

The control signal which turns on or off the switches 83 and 84 is given to the switches 83 and 84 via the I/O hardware control 513 from the CPU 508 of the engine control unit 510. The CPU 502 of the controller board 501 sends the ON/OFF request signal to the CPU 508 of the engine control unit 510 when the change of the energy saving mode to the normal-power mode is needed.

The fixing temperature of the fixing device 214 is maintained to the target temperature provided in the fixing processing of the plain paper which transferred the toner image, or a temperature a little lower than it.

In the standby mode (normal mode) which can answer a copy command or a print command and can start image formation without delay, the switches 83, 84 and 85 are all set to ON.

In the low-power mode (energy saving mode), the CPU 502 of the controller board 501 Switch 83 which gives ON instruction voltage +24V to the power supply relay in AC control circuit 540 energized to main heater 518 of the fixing device 214 is switched to OFF via the CPU 508 of engine control unit 510. That is, the CPU 502 intercepts the power supply to the AC control circuit 540.

The read image stored or registered in the HDD 503 without printed documentation in low-power mode, operation of the scanner 100 and the ADF 120 for image reading for facsimile transmission and image reading of the document sent to personal computer PC enables, switch 85 which supplies electric power to switch 84, control system, and communication system which supply electric power to a power system in +24V in +5V continues ON.

In the pause mode, the CPU 502 of controller board 501 carries out switch 85 which supplies electric power in switch 84 and +5V which supply electric power in +24V to both OFF via the CPU 508 of engine control unit 510. That is, the CPU 502 turns OFF all the switches 83-85.

However, in the pause mode, although the switches 83-85 are off, +5VE is applied to each detection signal line of the pressure plate switch of scanner 100, the document sensor of the ADF 120, and the power supply key switch of the operation board 101.

+5VE is continued and applied to the electrical circuit which detects the print command of personal computer PC, and the facsimile reception detection circuit of facsimile control unit FCU.

The relation between each mode of an above-mentioned energy-saving change and ON and OFF of electric supply switches 83-85 is shown in FIG. 5, and the information processing item permissible in each mode is shown in FIG. 6.

FAX in FIG. 6 means the facsimile transmission and reception of the FCU without printing, and DATA STORE means the storing of image data in the memory.

The capacitor power unit 80 which supplies electric power of +24VE, instead of +24VE of the main power supply, is provided in the power supply unit 514. The main part of the capacitor power unit 80 is the capacitor unit 89.

Figure 7:
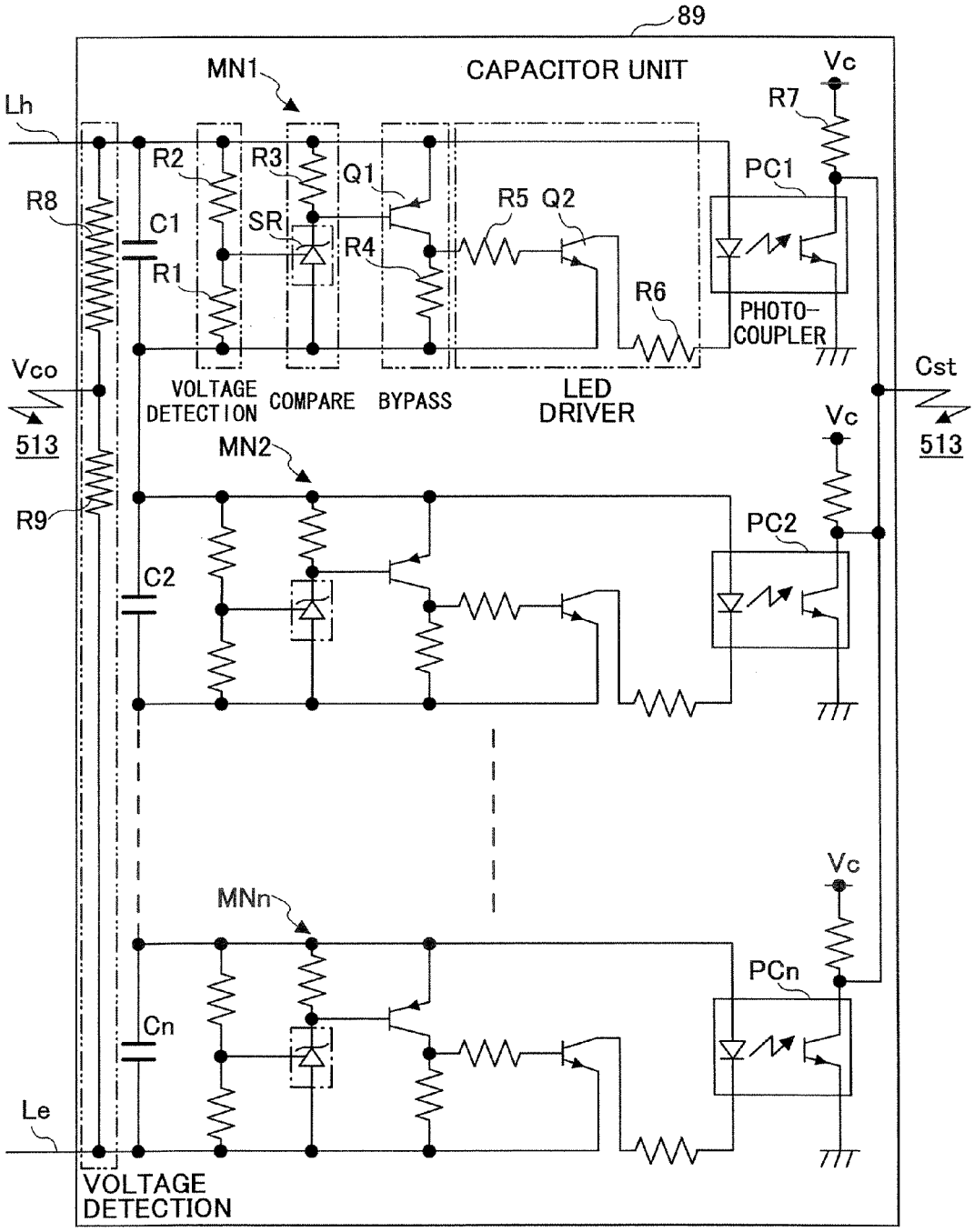
FIG. 7 is a diagram showing the composition of a capacitor unit.

The composition of the capacitor unit 89 will be described with reference to FIG. 7. FIG. 7 shows the composition of the capacitor unit 89.

As shown in FIG. 7, the capacitor unit 89 is connected to the dc output end of the DC-DC converter 88 which is a charging unit, and connected to the dc input end of the DC-DC converter 90 which is a power supplying unit.

The direct current voltage in which the rectify/smooth circuit 87 rectified the commercial alternating current voltage to which electric power is supplied through the AC relay 86 is applied to the DC-DC converter 88.

The constant-current-control circuit 88*ic* gives a switching pulse (PWM pulse) to the chopper circuit (switching circuit) energized to a primary the pressure regulation transformer in the DC-DC converter 88.

The constant-current-control circuit 88*ic* is a switching regulator which carries out PWM control (feedback constant current control) of the switching of a chopper circuit.

The charging current detector 88*id* amplifies the voltage (current detection voltage) proportional to the output current of resistance 88*r* for current detection inserted in the output current feedback loop of the rectify/smooth circuit on the side of the output of the pressure regulation transformer in the DC-DC converter 88, and it feeds back to the constant-current-control circuit 88*ic*.

The Constant-current-control circuit 88*ic* operates the pulse width of a PWM pulse, and gives it to a chopper circuit so that the fed-back charging current signal may agree on a target level. That is, the constant-current-control circuit 88*ic* carries out constant current control.

The charging current detector 88*id* has an amplifier which generates the 1st feedback signal of a low amplification factor, and the 2nd feedback signal of a high amplification factor, and an analog gate circuit which chooses one signal and is outputted to constant-current-control circuit 88*ic* as a feedback signal. The charging current detector 88*id* and the monitor signal Cst of the capacitor unit 89 will be described later.

If the monitor signal Cst is set to the high level H, indicating all the capacitors of the capacitor group which carried out series connection of two or more electric double layer capacitors being less than the predetermined voltage Vs, the 1st feedback signal of the low amplification factor is outputted to the constant-current-control circuit 88*ic*. If the monitor signal Cst is set to the low level L, indicating the charge voltage of at least one capacitor having reached the predetermined voltage Vs2, the 2nd feedback signal of the high amplification factor is outputted to the constant-current-control circuit 88*ic*.

By this charging current detector 88*id*, the constant-current-control circuit 88*ic*, if the constant current electric supply of the high-electric-current value is performed by the capacitor unit 89 and the charge voltage of at least one capacitor reaches predetermined voltage Vs2 while all the capacitors are less than the predetermined voltage Vs, the constant current electric supply of the low current value is performed by the capacitor unit 89.

FIG. 7 shows the composition of the capacitor unit 89. In this embodiment, the capacitor unit 89 is provided so that 18 electric double layer capacitors C1-Cn with the rated charge voltage 2.5V and the capacity 600 F (n=18) are connected in series, and is connected between the charge/discharge lines Lh/Le.

The voltage Vco between both ends of the series connection capacitor group between the charge/discharge lines Lh/Le, i.e., the rated voltage between the charge/discharge lines Lh/Le, is equal to 2.5×18=45V.

The monitor circuits MN1-MNn which have the same composition and the same characteristics are connected to the capacitors C1-Cn, respectively. The monitor circuit MN1 comprises a resistance division circuit (R1, R2) which detects the charge voltage of the capacitor, a compare/bypass circuit (SR, R3, Q1, R4) which detects whether the charge voltage of the capacitor reaches a reference voltage, a LED driver (R5, Q2, R6), a photo-coupler PC1, and a resistor R7.

The respective ends of the monitor circuits MN1-MNn are connected in common (logical addition connection). When all the outputs of the monitor circuits MN1-MNn are at the high level H, which indicates the capacitor voltage is lower than a predetermined voltage Vs2, the monitor signal Cst is set to the high level H. On the other hand, when the voltage of a capacitor Ci (any of the capacitors C1-Cn) reaches the predetermined voltage Vs2 and the monitor signal of the monitor circuit PCi connected to the capacitor Ci is reversed to the low level L, the monitor signal Cst is reversed to the low level L.

At the time of charging, the charge voltage (for example, 45V) from the DC-DC converter 88 is applied between the charge/discharge lines Lh/Le, and the constant-current-control circuit 88*ic* converts the charging current into a constant current which is equal to about 10 A.

When the charging of the capacitors C1-Cn with the constant-current is performed, the charge voltage of one capacitor Ci among the capacitors C1-Cn reaches the predetermined voltage Vs2.

Then, the shunt regulator SR of the monitor circuit MNi connected to the capacitor Ci is turned ON (conduction) and the PNP transistor Q1 is turned ON, so that the charging current to the capacitor Ci is bypassed and the charging of the capacitor Ci is completed.

The NPN transistor Q2 is turned ON when the PNP transistor Q1 is turned ON, and the light emitting diode of the photo-coupler PCi lights up and the photo-transistor is turned ON. Thus, the level of the monitor signal Cst is changed from the high level H to the low level L.

The predetermined voltage Vs2 is the voltage value at which the charging current is bypassed when this voltage value is reached. The voltage Vs2 is predetermined as being slightly smaller than the rated voltage of an electric double-layer capacitor.

The predetermined voltage Vs2 is represented, using a reference voltage VR1 of the shunt regulator SR and a resistance R2 and a resistance R1 of the resistance division circuit, in accordance with the formula: Vs2=VR1(1+R2/R1).

In the power supply unit 514, the connection switch circuit 90*d* is provided, and one of +24VE of the DC-DC converter 82 of the main power supply and +24VE of the DC-DC converter 90 of the capacitor power unit 80 is selectively connected to the switch SW 84 by this connection switch circuit 90*d*.

Figure 8:
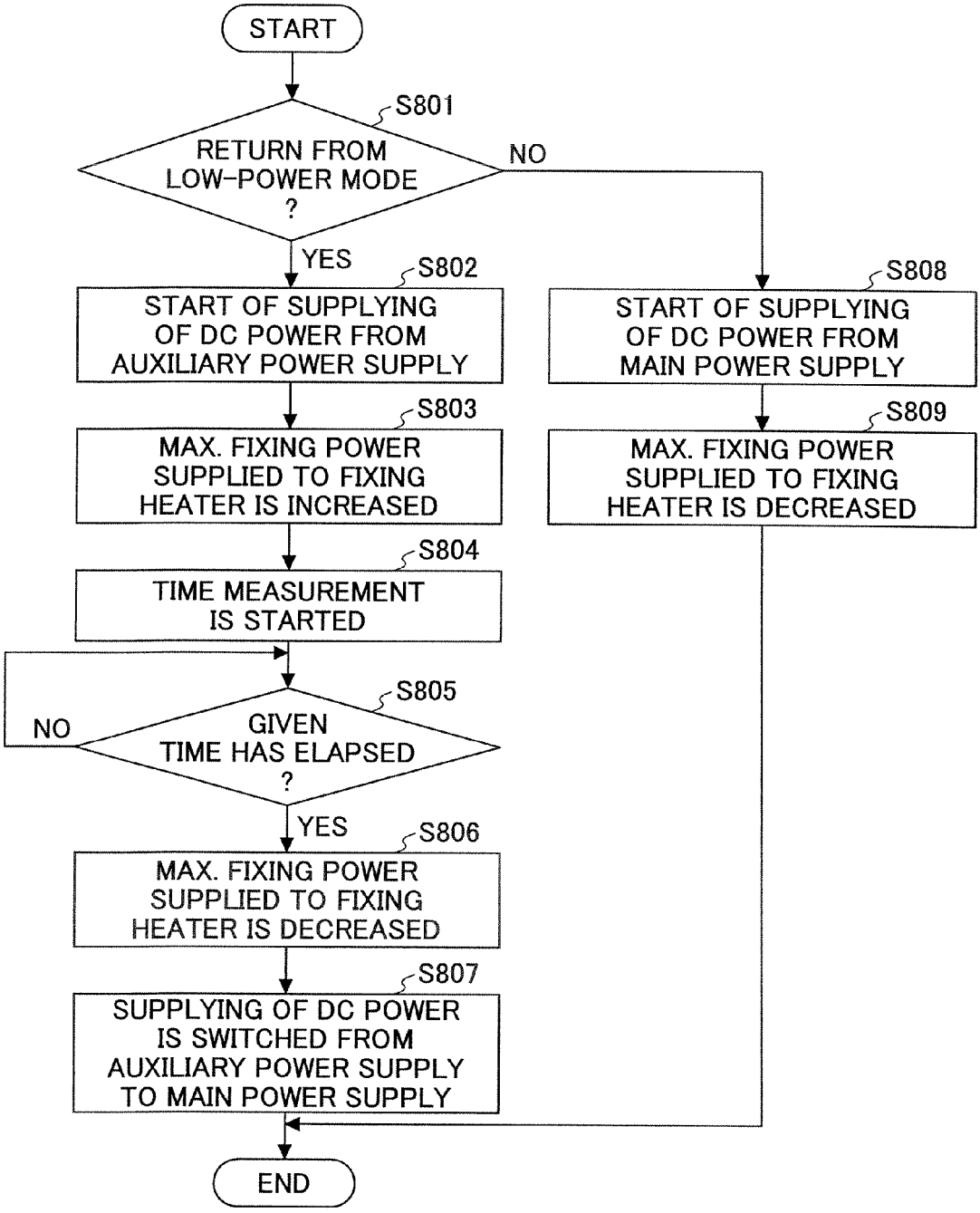
FIG. 8 is a flowchart for explaining operation of an image forming device in an embodiment of the invention.

Next, operation of an image forming device in an embodiment of the invention will be explained with reference to FIG. 8. FIG. 8 is a flowchart for explaining operation of the image forming device.

As shown in FIG. 8, it is determined whether the warm-up of an image forming device is caused by a return from the low-power mode (step S801). When it is determined that it is caused by the return from the low-power mode, +24VE is supplied from the auxiliary power supply (capacitor power unit 80) by the connection switch circuit 90*d* shown in FIG. 4. That is, +24VE from the DC-DC converter 82 of the main power supply is not connected (step S802).

At this time, the heater of the fixing unit 214 is controlled by the AC control circuit enlarge the maximum supply capability. Therefore, the increase of the temperature of the fixing unit 214 can be made quickly (step S803).

If the maximum supply capability is increased, the timer is started (step S804) and it is determined whether the predetermined time has elapsed (step S805).

The image forming device is set in a waiting condition until the predetermined time has elapsed. After the predetermined time has elapsed, the fixing unit 214 is heated sufficiently, and the heater is controlled and the maximum supply capability is made small (step S806).

At this time, connection is changed from supply of +24VE from the auxiliary power supply (capacitor power unit 80) to supply of +24VE from the DC-DC converter 82 of the main power supply by the connection switch circuit 90*d*, and the electric discharge from the auxiliary power supply is suspended (step S807).

When the warm-up of the image forming device is not caused by the return from the low-power mode, +24VE is supplied from the DC-DC converter 82 of the main power supply by the connection switch circuit 90*d* shown in FIG. 4.

At this time, the heater of the fixing unit 214 is controlled by the AC control circuit to make the maximum supply capability small (step S809).

After an end of copy operation, the low-power mode is the first low power state set up automatically, when there is no operation over a fixed time.

Figure 9:
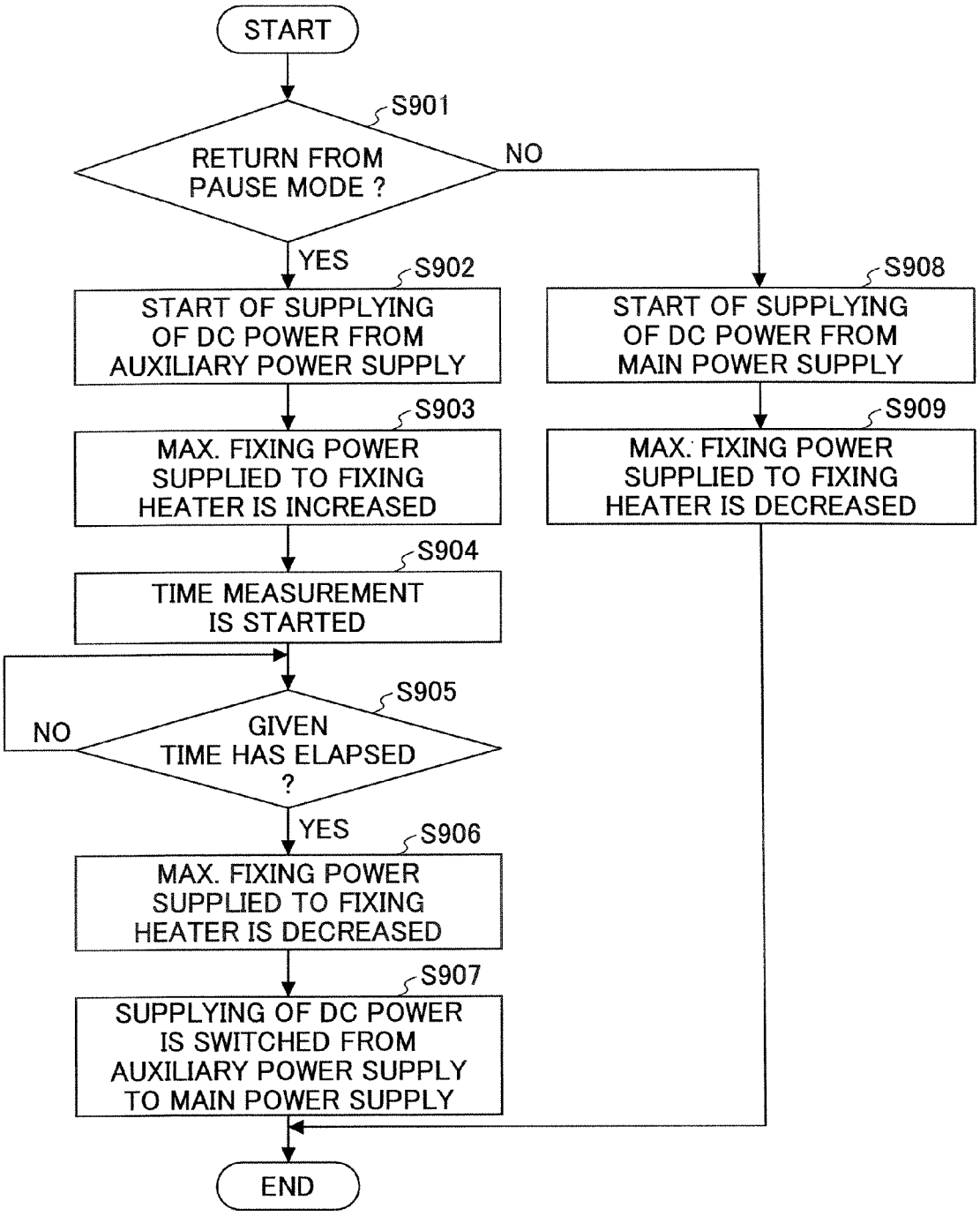
FIG. 9 is a flowchart for explaining operation of an image forming device in an embodiment of the invention.

Next, operation of an image forming device in an embodiment of the invention will be explained with reference to FIG. 9. FIG. 9 is a flowchart for explaining operation of the image forming device.

As shown in FIG. 9, it is determined whether the warm-up of the image forming device is caused by return from the pause mode (step S901). When it is determined that it is the return from the pause mode, +24VE is supplied from the auxiliary power supply (capacitor power unit 80) by the connection switch circuit 90*d* shown in FIG. 4.

That is, +24VE from the DC-DC converter 82 of the main power supply is not connected (step S902). At this time, the heater of the fixing unit 214 is controlled by the AC control circuit to enlarge the maximum supply capability. Therefore, the increase of the temperature of the fixing unit can be made quickly (step S903). If the maximum supply capability to the fixing unit 214 becomes large, the timer is started (step S904).

The image forming device is set in a waiting condition until the predetermined time has elapsed. And the fixing unit 214 is controlled after the predetermined time has elapsed, so that it is heated to sufficient temperature and the maximum supply capability to the heater is made small (step S906).

At this time, connection is changed from supply of +24VE from the auxiliary power supply (capacitor power unit 80) to supply of +24VE from the DC-DC converter 82 of the main power supply by the connection switch circuit 90*d*, and the electric discharge from the auxiliary power supply is suspended (step S907).

When the warm-up of the image forming device is not caused by the return from the pause mode, +24VE is supplied from the DC-DC converter 82 of the main power supply by the connection switch circuit 90*d* shown in FIG. 4 (step S908).

At this time, the heater of the fixing unit 214 makes the maximum supply capability small, and controls it by AC control circuit (step S909).

The off-mode which is the power condition set up by the function to set up OFF state automatically, pause mode, when fixed time and a copy are not performed, when in the case of a composite machine it continues at low-power mode and output operation is not performed, it is the sleep mode which is the second low power state realized continuously.

Figure 10:
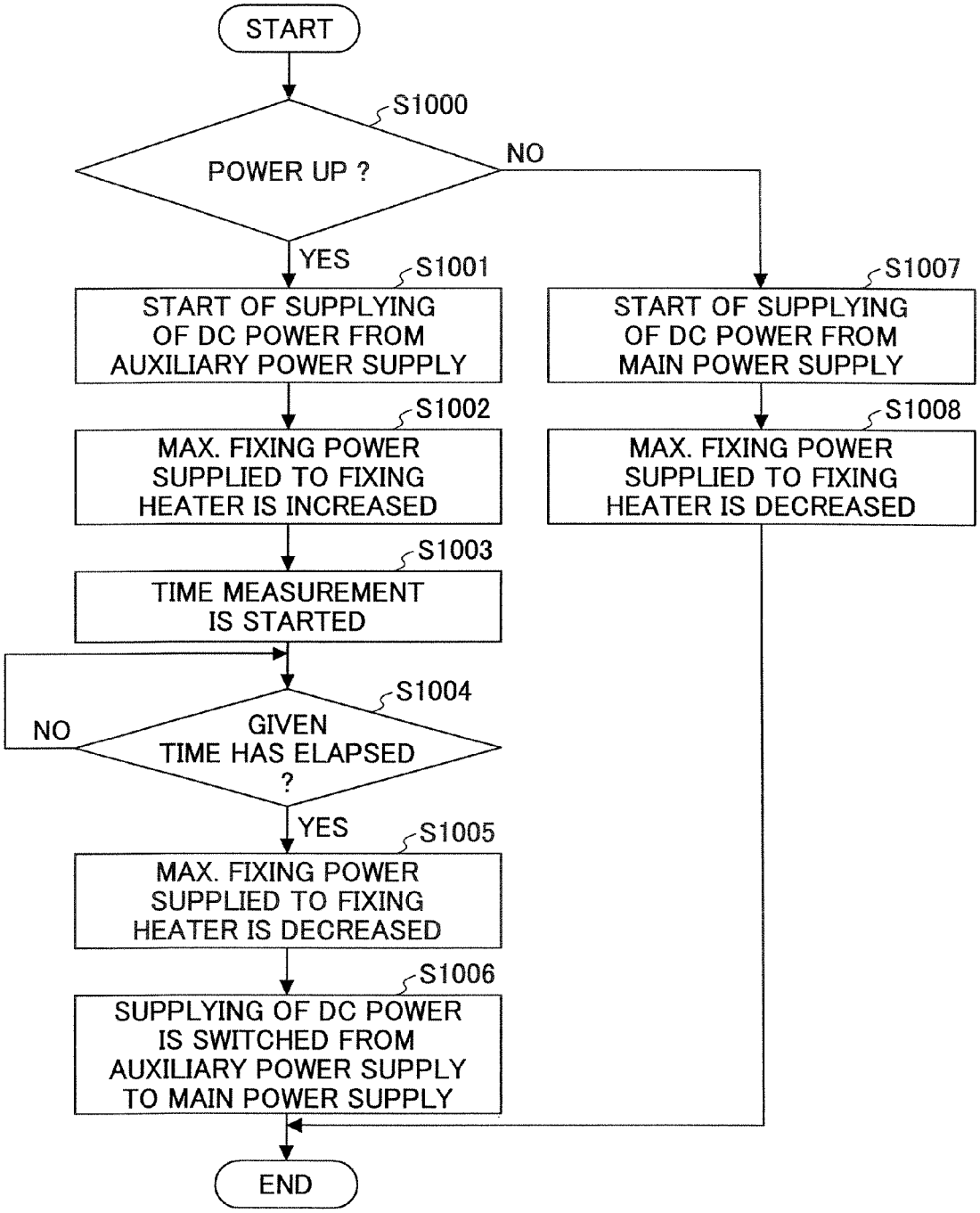
FIG. 10 is a flowchart for explaining operation of an image forming device in an embodiment of the invention.

Next, operation of an image forming device in an embodiment of the invention will be explained with reference to FIG. 10. FIG. 10 is a flowchart for explaining operation of the image forming device.

It is determined whether the warm-up of the image forming device is started by power up (step S1000). In the case of power up, +24VE is supplied from the auxiliary power supply (capacitor power unit 80) by the connection switch circuit 90*d* shown in FIG. 4.

That is, +24VE from the DC-DC converter 82 of the main power supply is not connected (step S1001).

At this time, the heater of the fixing unit 214 enlarges the maximum supply capability, and controls it by AC control circuit. Therefore, the increase of the temperature of a fixing assembly can be made quickly (step S1002).

If the maximum supply capability is supplied to the fixing unit 214, the timer starts (step S1003).

The image forming device is set in a waiting condition until the predetermined time has elapsed, and the fixing unit 214 is also heated by sufficient temperature, makes the maximum supply capability to a heater small, and controls after the predetermined time has elapsed (step S1005).

At this time, connection is changed from supply of +24VE from the auxiliary power supply (capacitor power unit 80) to supply of +24VE from DC-DC converter 82 of main power supply by the connection switch circuit 90*d*, and the electric discharge from the auxiliary power supply is suspended (step S1006).

When the warm-up of the image forming device is not started by power up, +24VE is supplied from the DC-DC converter 82 of the main power supply by the connection switch circuit 90*d* shown in FIG. 4 (step S1007).

At this time, the heater of the fixing unit 214 makes the maximum supply capability small, and controls it by the AC control circuit (step S1008).

Next, control of an image forming device in an embodiment of the invention will be explained with reference to FIGS. 11-14.

In the case of the return from the low-power mode of the image forming device, the following explanation explains, but the power up of the image forming device concerning the return from the pause mode of the image forming device is also the same.

Figure 11:
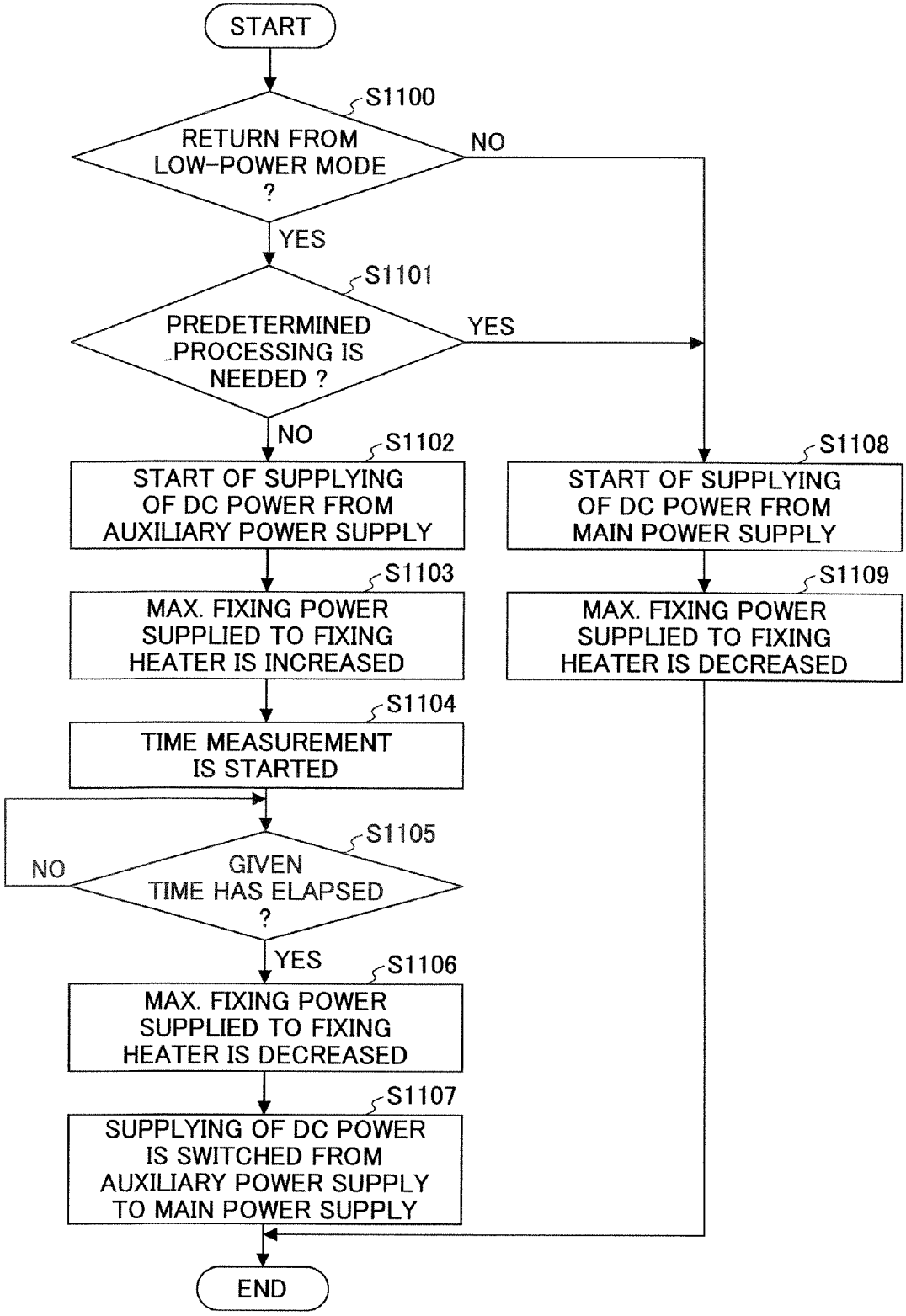
FIG. 11 is a flowchart for explaining operation of an image forming device in an embodiment of the invention.

FIG. 11 is a flowchart for explaining operation of an image forming device in an embodiment of the invention.

As shown in FIG. 11, it is determined whether the warm-up of the image forming device is started by a return from the low-power mode (step S1100). When it is determined that the return from the low-power mode occurs, it is determined whether any predetermined processing is needed (step S1101).

When no predetermined processing is needed, +24VE is supplied from the auxiliary power supply (capacitor power unit 80) by the connection switch circuit 90*d* shown in FIG. 4.

That is, +24VE from DC-DC converter 82 of main power supply is not connected (step S1102). At this time, the heater of the fixing unit 214 enlarges the maximum supply capability, and controls it by AC control circuit. Therefore, the increase of the temperature of the fixing unit 214 can be made quickly (step S1103).

If the maximum supply capability to the fixing unit 214 becomes large, the timer starts (step S1104) and it is determined whether the predetermined time has elapsed (step S1105).

Predetermined time standby is carried out, and the fixing unit 214 is fully heated, makes the maximum supply capability to a heater small, and controls after the predetermined time has elapsed (step S1106).

At this time, from supply of auxiliary power supply (capacitor power unit 80): +24VE, connection is changed from DC-DC converter 82 of main power supply to supply of +24VE, and the electric discharge from the auxiliary power supply is suspended by the connection switch circuit 90*d* (step S1107).

When it is determined that there is predetermined processing, +24VE is supplied from DC-DC converter 82 of main power supply by the connection switch circuit 90*d* shown in FIG. 4 (step S1108). At this time, the heater of the fixing unit 214 makes the maximum supply capability small, and controls it by AC control circuit (step S1109).

Since some time is required, it is not necessary to make the increase of the temperature of a fixing assembly quick at the processing predetermined, and useless electric discharge of the auxiliary power supply can be prevented.

Similarly, when it is determined that the warm-up of the image forming device is not caused by the return from the low-power mode, +24VE is supplied from the DC-DC converter 82 of the main power supply by the connection switch circuit 90*d* shown in FIG. 4 (step S1108).

At this time, the heater of the fixing unit 214 makes the maximum supply capability small, and controls it by AC control circuit (step S1109).

The predetermined processing in this case is any of image positioning processing, process condition processing, controller starting processing, toner supply request processing, sheet supply request processing, used-toner disposal request processing, and used-sheet removal request processing.

Next, an example of image positioning processing will be explained.

In the color image forming device which forms two or more color images, the image of each color is piled up unlike monochrome image, and if the image position of each color shifts, the color of a line drawing or a character will change, or image unevenness (color phase irregularity) will occur, and it will lead to deterioration of image quality.

Therefore, it is necessary to double the image position of each color as much as possible. In the image forming device which forms a color image from such a thing using two or more the photoconductors. The deviation of the main scanning direction (it is a right-angled direction to the transportation direction of a recording paper or the feed direction of a transfer belt) generated according to various factors, such as change of environmental temperature and change of a temperature inside the plane, is rectified as follows.

The reference part which consists of a straight line prolonged in a main scanning direction, and the slash aslant prolonged to the feed direction of a transfer belt are formed on a transfer belt.

Thereafter, the datum line and slash is detected by the sensor, and the amount of gap of the main scanning direction of a slash is calculated by the CPU based on the fiducial point memorized by the measured value and memory of the main scanning direction gap of the reference part and slash which are obtained based on the detection signal from the sensor.

Based on the result of an operation, either the write-in start timing of a main scanning direction or a write-in clock frequency is rectified. By such compensation, the deviation not only by an environmental variation but aging can be rectified, and a high-definition image without a color gap can be obtained.

Generally, the time of about 1 to 5 minutes is needed for the above processing. Every fixed number of sheets and beyond fixed time determine determination of the necessity of processing by change of environmental temperature etc.

Figure 12:
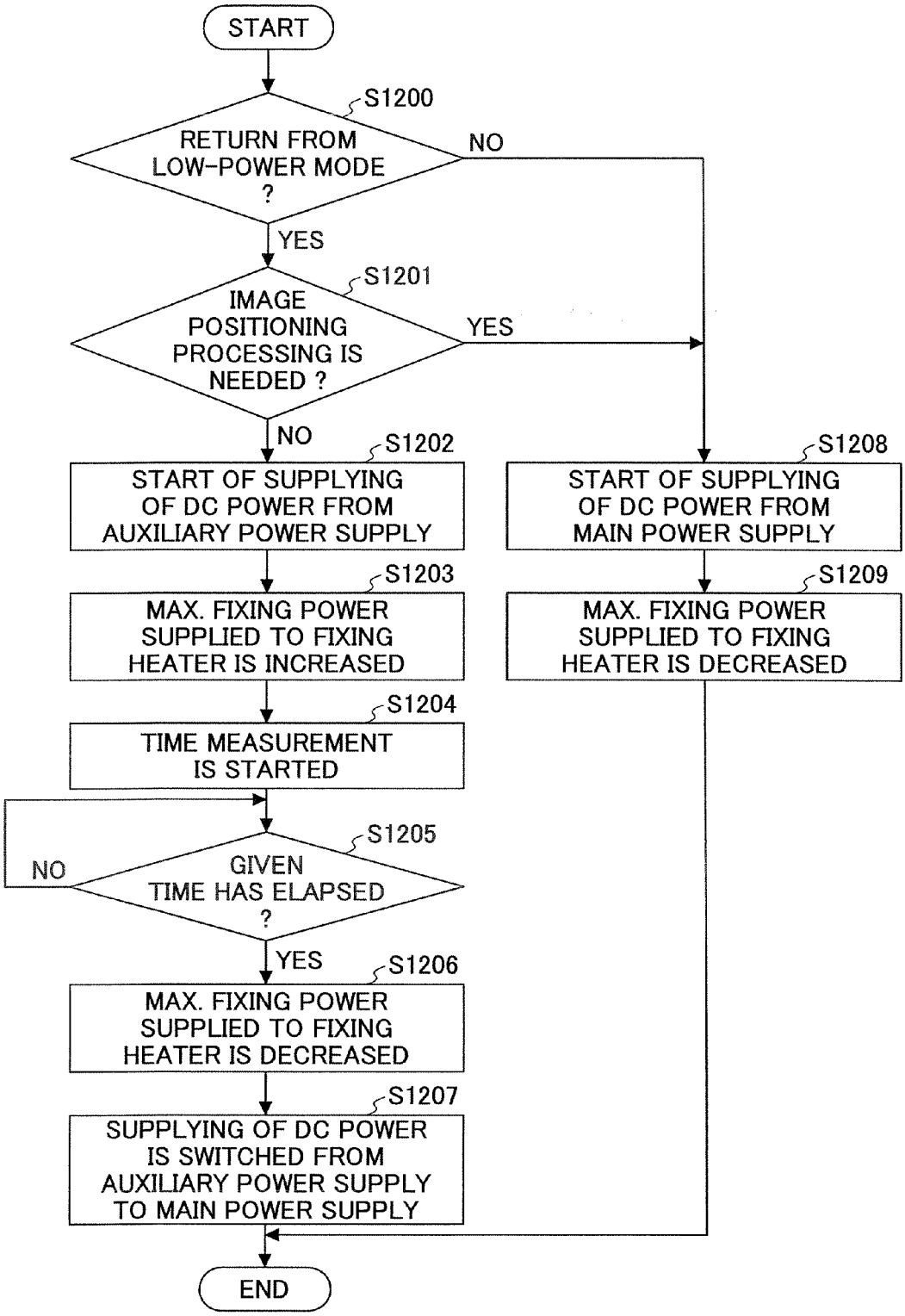
FIG. 12 is a flowchart for explaining operation of the image forming device when the predetermined processing is image positioning processing.

FIG. 12 is a flowchart for explaining operation of the image forming device when the predetermined processing is image positioning processing.

The difference between the flowchart shown in FIG. 12 and the flowchart shown in FIG. 11 is that determination of whether there is any predetermined processing of step S1101 of FIG. 11 is replaced with determination of whether there is any image positioning processing of step S1201. That is, step S1200 of FIG. 12 is essentially the same as step S1100 of FIG. 11 and steps S1202-S1209 of FIG. 12 are essentially the same as steps S1102-S1109 of FIG. 11, and a description of the flowchart of FIG. 12 will be omitted.

Next, an example of process condition processing will be explained. In the image forming device, the consumable devices, such as the charging unit, the optical writing unit, the photoconductor and the developing unit, are used.

These consumable devices may cause change by their characteristics change and aging to environmental variations, such as temperature and humidity. For this reason, the image formation state of the image obtained by carrying out electrification exposure of the photoconductor becomes unstable by the change of the consumable device characteristics.

Then, the image formation process conditions are controlled according to the change of the characteristics of the consumable devices, including the charging unit, the optical writing unit, the photoconductor and the developing unit, and stabilization of the image formation state is attained.

On the image support (or the transfer belt) which supports the toner image, the photosensor detects the toner density, and the bias voltage, the exposure quantity of light, etc. are adjusted based on the detection value. The time of about 1 to 4 minutes is needed for the above processing in general. Every fixed number of sheets and beyond fixed time determine determination of the necessity of processing by change of environmental temperature etc.

Figure 13:
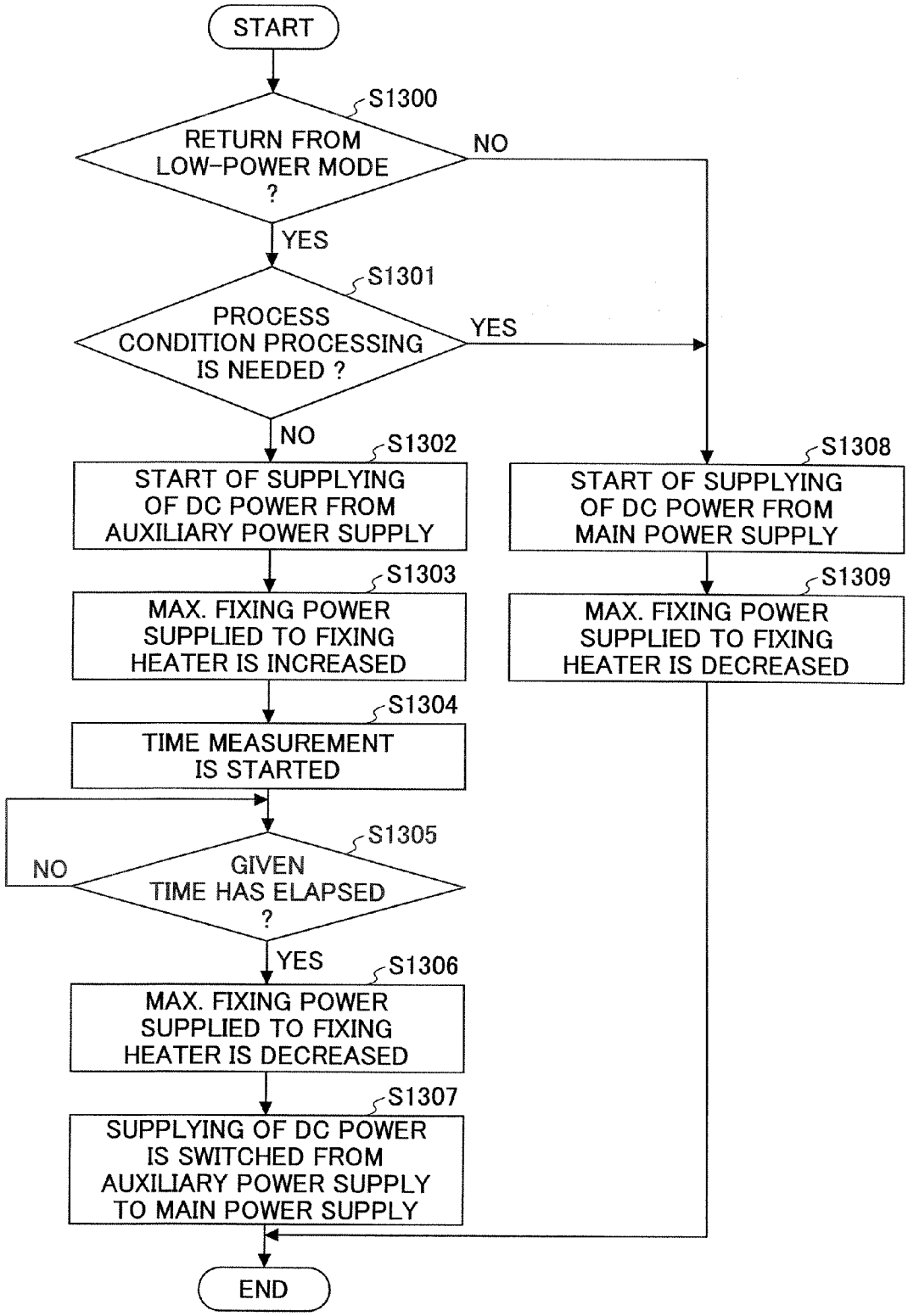
FIG. 13 is a flowchart for explaining operation of the image forming device when the predetermined processing is process condition processing.

FIG. 13 is a flowchart for explaining operation of the image forming device when the predetermined processing is process condition processing.

The difference between the flowchart shown in FIG. 13 and the flowchart shown in FIG. 11 is that determination of whether there is any predetermined processing of step S1101 of FIG. 11 is replaced with determination of whether there is any process condition processing of step S1301. That is, step S1300 of FIG. 13 is essentially the same as step S1100 of FIG. 11 and steps S1302-S1309 of FIG. 13 are essentially the same as steps S1102-S1109 of FIG. 11, and a description of the flowchart of FIG. 13 will be omitted.

Next, an example of controller starting processing will be explained.

In the controller starting processing, the check of RAM and RAM, the initialization of ROM, the work memory, the frame memory, the ASIC, etc., and the loading of data from the NV-RAM, etc. are performed. In the case of expensive ROM, the program is memorized in a compressed format and it is performed by developing the program on the RAM. The starting of the OS is also included. The above processing differs according to the contents of the execution of the program, and the time ranging several seconds to several minutes is needed.

Determination of the necessity of processing is determined in the state of the controller (low-power mode, pause mode, power supply OFF).

Figure 14:
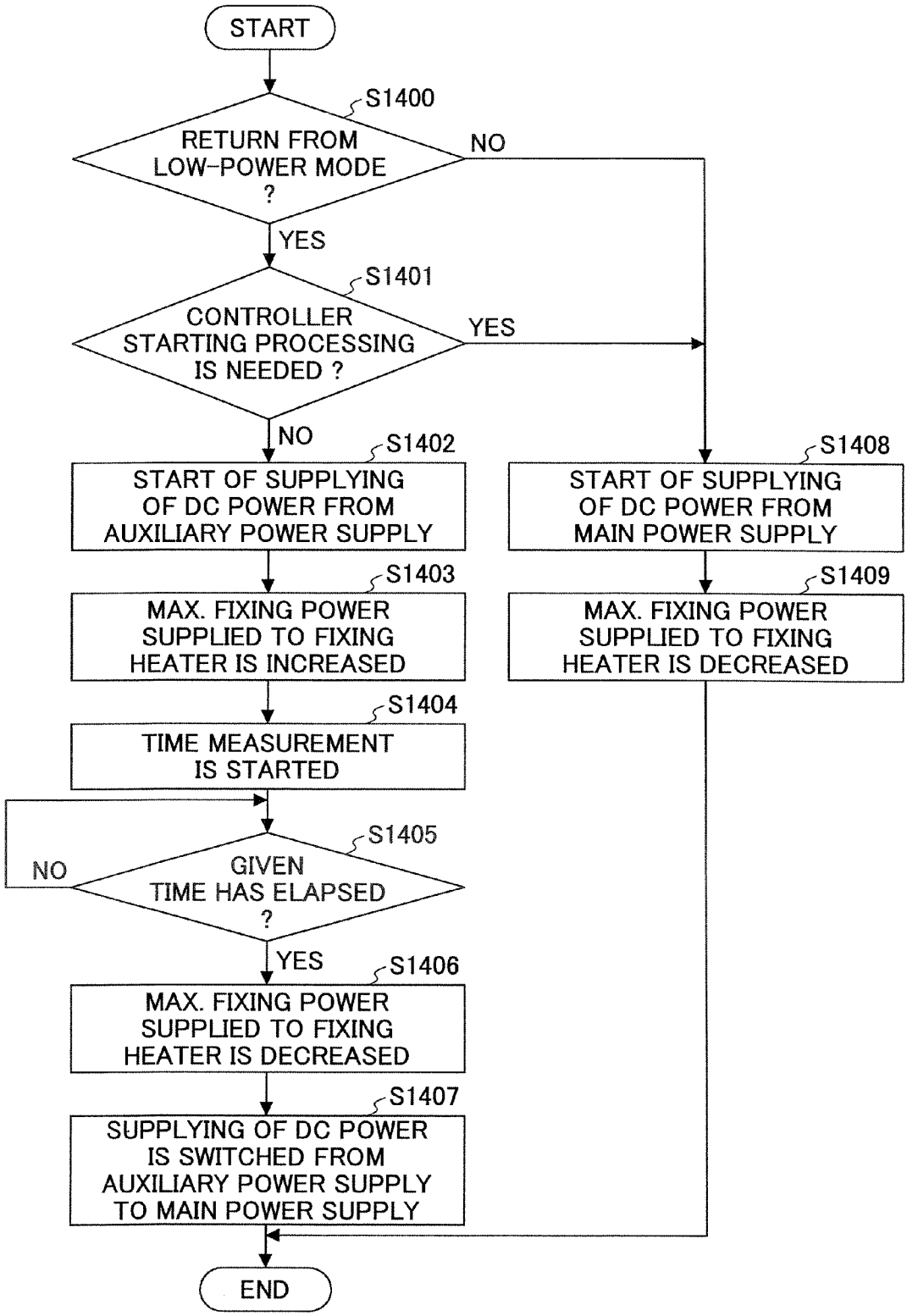
FIG. 14 is a flowchart for explaining operation of the image forming device when the predetermined processing is image positioning processing.

FIG. 14 is a flowchart for explaining operation of the image forming device when the predetermined processing is controller starting processing.

The difference between the flowchart shown in FIG. 14 and the flowchart shown in FIG. 11 is that determination of whether there is any predetermined processing of step S1101 of FIG. 11 is replaced with determination of whether there is any controller starting processing of step S1401. That is, step S1400 of FIG. 14 is essentially the same as step S1100 of FIG. 11 and steps S1402-S1409 of FIG. 14 are essentially the same as steps S1102-S1109 of FIG. 11, and a description of the flowchart of FIG. 14 will be omitted.

Next, an example of toner supply request processing will be explained.

Figure 15:
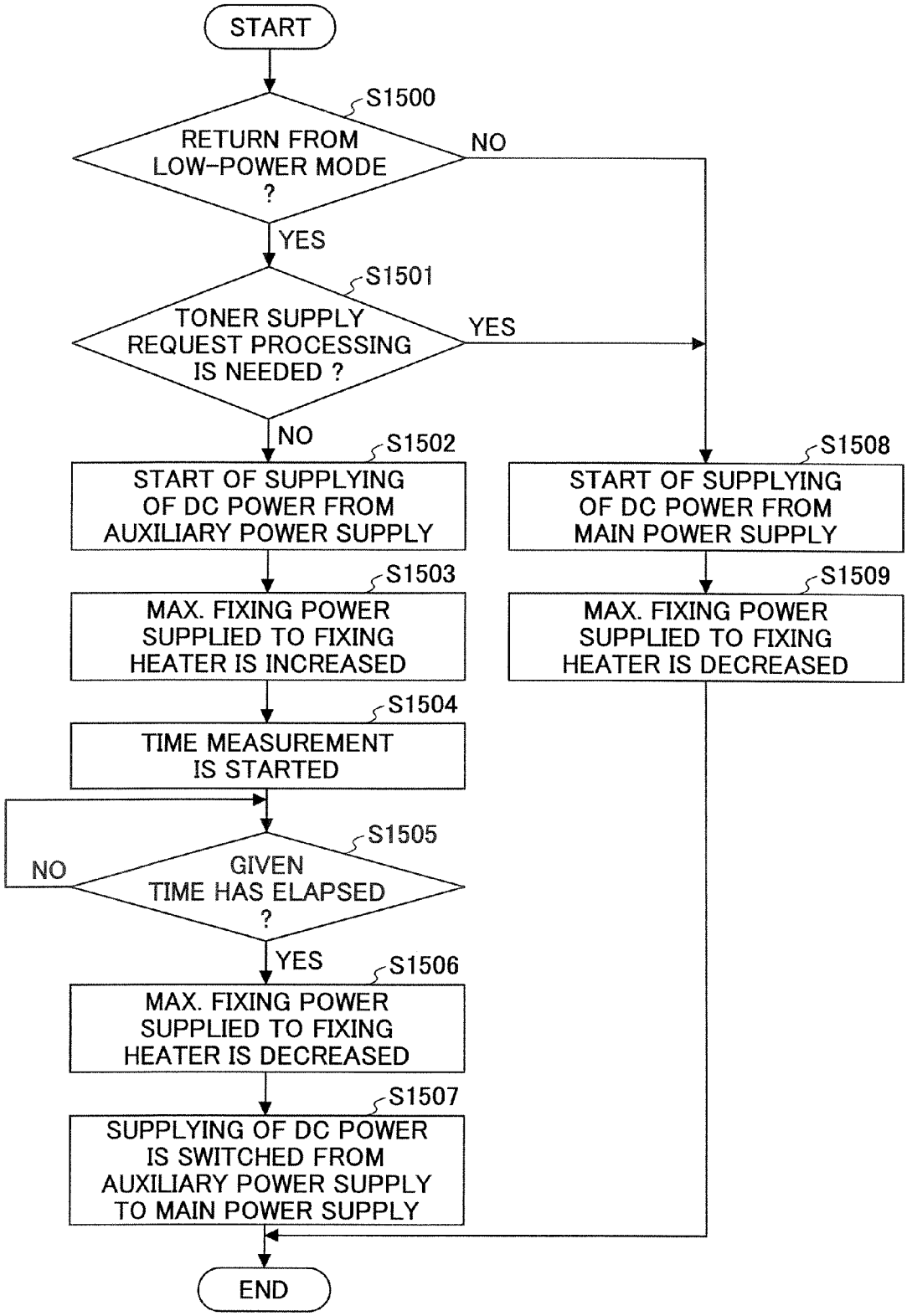
FIG. 15 is a flowchart for explaining operation of the image forming device when the predetermined processing is toner supply request processing.

FIG. 15 is a flowchart for explaining operation of the image forming device when the predetermined processing is toner supply request processing.

The difference between the flowchart shown in FIG. 15 and the flowchart shown in FIG. 11 is that determination of whether there is any predetermined processing of step S1101 of FIG. 11 is replaced with the toner supply request processing of step S1501. That is, step S1500 of FIG. 15 is essentially the same as step S1100 of FIG. 11, and steps S1502-S1509 of FIG. 14 are essentially the same as steps S1102-S1109 of FIG. 11, and a description of the flowchart of FIG. 15 will be omitted.

In the image forming device using the flowchart shown in FIG. 15, toner is lost to the user. It is preferred to perform a message indication, such as the toner cartridge should be replaced with a new one. Determination of the necessity of processing is determined in the amount of toner which is contained in the image forming device. In order to terminate the processing, it is necessary to change the cartridge to a new toner cartridge.

Figure 16:
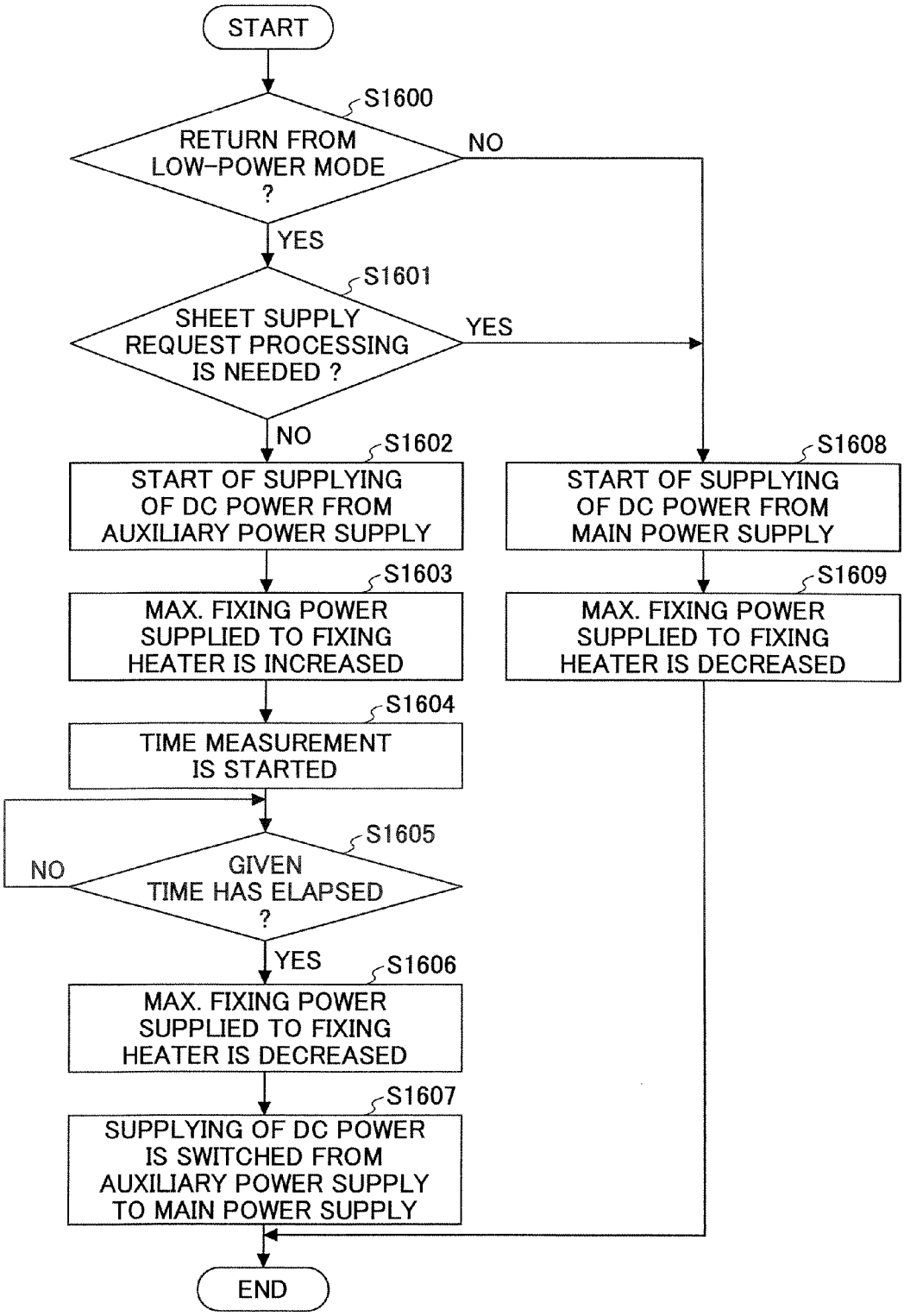
FIG. 16 is a flowchart for explaining operation of the image forming device when the predetermined processing is sheet supply request processing.

Next, an example of sheet supply request processing will be explained. FIG. 16 is a flowchart for explaining operation of the image forming device when the predetermined processing is sheet supply request processing.

The difference between the flowchart shown in FIG. 16 and the flowchart shown in FIG. 11 is that determination of whether there is any predetermined processing of step S1101 of FIG. 11 is replaced with determination of whether sheet supply request processing is needed of step S1601. That is, step S1600 of FIG. 16 is essentially the same as step S1100 of FIG. 11 and steps S1602-S1609 of FIG. 16 are essentially the same as steps S1102-S1109 of FIG. 11, and a description of the flowchart of FIG. 16 will be omitted.

In the image forming device using the flowchart shown in FIG. 16, it is preferred to perform a message indication, such as "sheets should be set to the sheet tray", to the user. Determination of the necessity of processing is made according to the number of sheets contained in the sheet tray of the image forming device. In order to terminate the processing, it is necessary to set sheets to the sheet tray.

Next, an example of used-toner disposal request processing will be explained.

Figure 17:
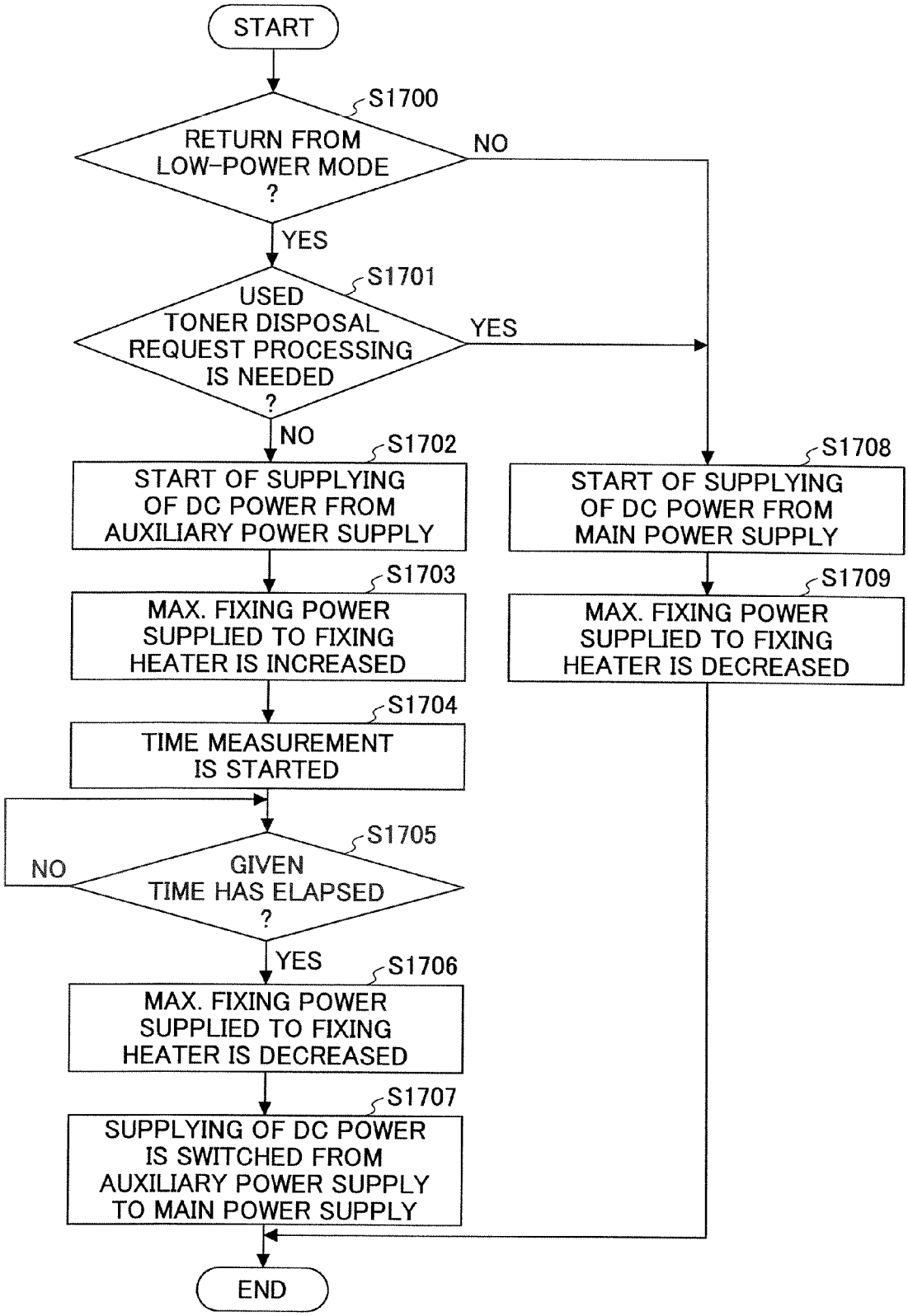
FIG. 17 is a flowchart for explaining operation of the image forming device when the predetermined processing is used-toner disposal request processing.

FIG. 17 is a flowchart for explaining operation of the image forming device when the predetermined processing is used-toner disposal request processing.

The difference between the flowchart shown in FIG. 17 and the flowchart shown in FIG. 11 is that determination of whether there is any predetermined processing of step S1101 of FIG. 11 is replaced with determination of whether used-toner disposal request processing is needed of step S1701. That is, step S1700 of FIG. 17 is essentially the same as step S1100 of FIG. 11 and steps S1702-S1709 of FIG. 17 are essentially the same as steps S1102-S1109 of FIG. 11, and a description of the flowchart of FIG. 17 will be omitted.

In the image forming device using the flowchart shown in FIG. 17, a message indication, such as exchange the used-toner bottle, is performed to the user.

Determination of whether the used-toner removal is needed at the time of cleaning of the photoconductor of the image forming device or the transfer belt of the necessity of processing in the quantity with which the used-toner bottle is filled up. In order to terminate the processing, it is necessary to change the used-toner bottle with a new one.

Next, the case of used-sheet removal request processing will be explained. In used-sheet, processing predetermined in FIG. 18 is a figure in which removing and showing an example of the flowchart in the case of being request processing.

Figure 18:
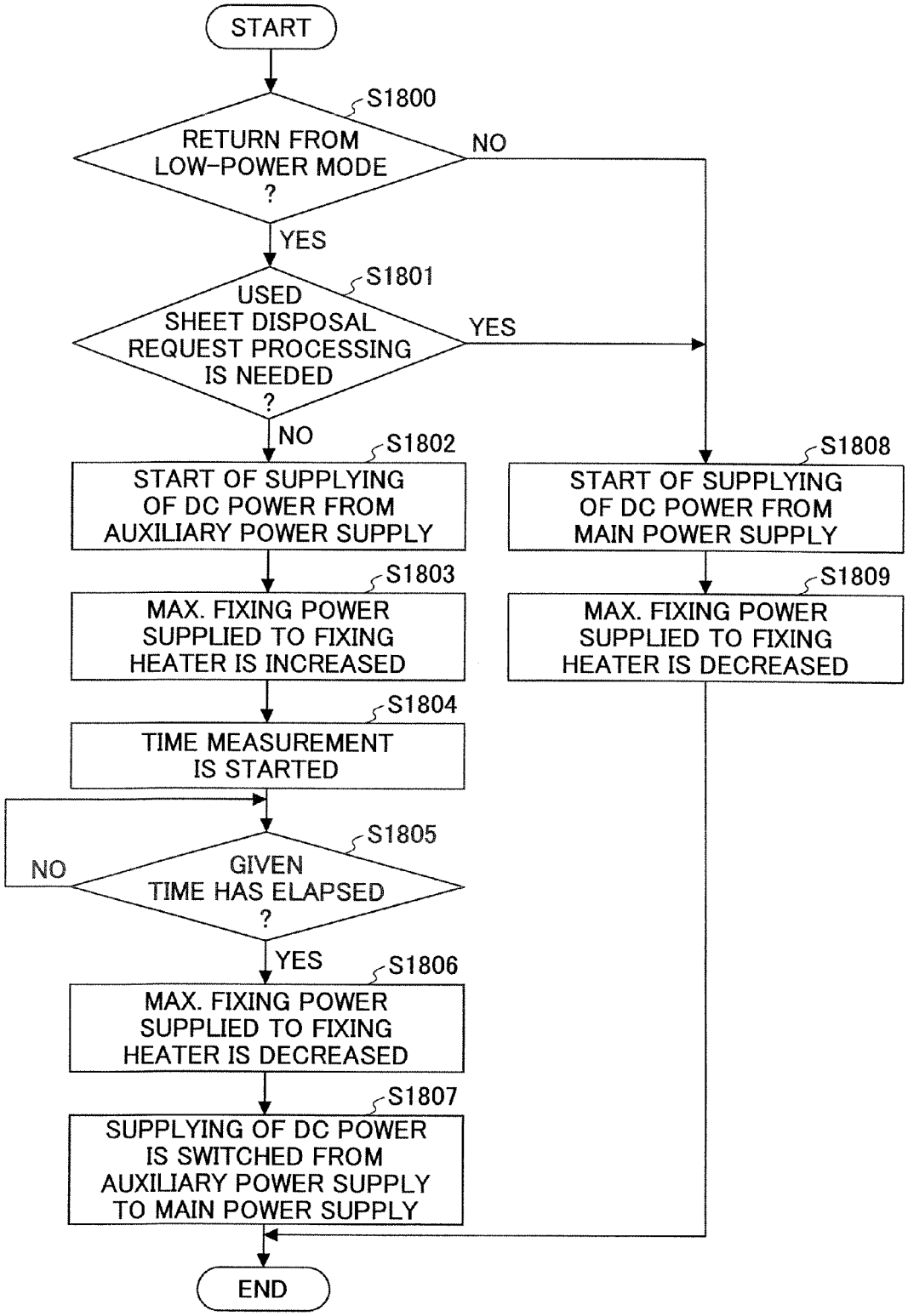
FIG. 18 is a flowchart for explaining operation of the image forming device when the predetermined processing is used-sheet removal request processing.

The difference between the flowchart shown in FIG. 18 and the flowchart shown in FIG. 11 is that determination of whether there is any predetermined processing of step S1101 of FIG. 11 is replaced with the used-sheet removal request processing of step S1801. That is, step S1800 of FIG. 18 is essentially the same as step S1100 of FIG. 11 and steps S1802-S1809 of FIG. 18 are essentially the same as steps S1102-S1109 of FIG. 11, and a description of the flowchart of FIG. 18 will be omitted.

In the image forming device using the flowchart shown in FIG. 18, it is preferred to perform a message indication, such as the sheets of the paper output tray should be removed, to the user.

Determination of the necessity of processing is made according to the number of sheets on the paper output tray of the image forming device. In order to terminate processing, it is necessary to remove the sheet of the paper output tray.

In an embodiment of the invention which solves or reduces one or more of the above-mentioned problems, there is provided an image forming device comprising: a main power supply supplying AC power and DC power to a load of the image forming device; an auxiliary power supply storing DC power and supplying the stored DC power to the load; and a control unit adapted to control the main power supply and the auxiliary power supply so that the stored DC power of the auxiliary power supply is supplied to the load during a predetermined period after any of return from a low-power mode to a normal-power mode, return from a pause mode to the normal-power mode, and power-up of the image forming device occurs, wherein the control unit is adapted to control the main power supply and the auxiliary power supply when a predetermined processing is performed upon starting of the image forming device, so that the supplying of the stored DC power of the auxiliary power supply to the load is not performed and the AC power and the DC power from the main power supply are supplied to the load.

The above-mentioned image forming device may be configured so that the predetermined processing is image positioning processing.

The above-mentioned image forming device may be configured so that the predetermined processing is process condition processing.

The above-mentioned image forming device may be configured so that the predetermined processing is controller starting processing.

The above-mentioned image forming device may be configured so that the predetermined processing is toner supply request processing.

The above-mentioned image forming device may be configured so that the predetermined processing is sheet supply request processing.

The above-mentioned image forming device may be configured so that the predetermined processing is used-toner disposal request processing.

The above-mentioned image forming device may be configured so that the predetermined processing is used-sheet removal request processing.

According to embodiments of the image forming device of the invention, it is possible to supply DC power from the auxiliary power supply, which is constructed with a simple structure, to the DC load, such that the power consumption of the image forming device is kept from exceeding the permissible electric power capacity even if a steep change of the load occurs. According to embodiments of the image forming device of the invention, it is possible to shorten of the time for starting of the image forming device, including starting of the fixing heater, after power-up of the image forming device or return from a low-power mode occurs.

The present invention is not limited to the above-described embodiments, and variations and modifications may be made without departing from the scope of the present invention.

Further, the present application is based on and claims the benefit of priority of Japanese patent application No. 2005-318775, filed on Nov. 1, 2005, and Japanese patent application No. 2005-346366, filed on Nov. 30, 2005, the entire contents of which are hereby incorporated by reference.

What is claimed is:

1. An image forming device, comprising:

a main power supply that supplies AC power and DC power to a load of the image forming device;

an auxiliary power supply that stores DC power and supplies the stored DC power to the load; and a control unit adapted to control the main power supply and the auxiliary power supply so that the stored DC power of the auxiliary power supply is supplied to the load during a predetermined period after any of a return from a low-power mode to a normal-power mode, a return from a pause mode to the normal-power mode, and a power-up of the image forming device occurs, wherein the auxiliary power supply does not supply the stored DC power to the load, and the main power supply supplies the AC power and the DC power to the load if it is determined that a predetermined processing is performed upon a starting of the image forming device, the auxiliary power supply supplies the stored DC power to the load, it is determined whether a predetermined time has elapsed, and the main power supply does not supply the AC power and the DC power to the load if it is determined that the predetermined processing is not performed upon the starting of the image forming device, and a decision whether the predetermined processing is performed is made based on at least one of a number of sheets, an elapsed time, and an environmental temperature.

2. The image forming device according to claim 1, wherein the predetermined processing is an image positioning processing.

3. The image forming device according to claim 1, wherein the predetermined processing is a process condition processing.

4. The image forming device according to claim 1, wherein the predetermined processing is a controller starting processing.

5. The image forming device according to claim 1, wherein the predetermined processing is a toner supply request processing.

6. The image forming device according to claim 1, wherein the predetermined processing is a sheet supply request processing.

7. The image forming device according to claim 1, wherein the predetermined processing is a used-toner disposal request processing.

8. The image forming device according to claim 1, wherein the predetermined processing is a used-sheet removal request processing.

9. The image forming device according to claim 1, wherein the stored DC power of the auxiliary power supply is supplied to the load during the predetermined period after each of the return from the low-power mode to the normal-power mode, the return from the pause mode to the normal-power mode, and the power-up of the image forming device occurs.

10. The image forming device according to claim 1, wherein it is determined whether a warm-up of the image forming device is started by the return from the low-power mode, and the auxiliary power supply supplies the stored DC power to the load if it is both determined that the warm-up of the image forming device is started by the return from the low-power mode and the predetermined processing is not performed.

11. The image forming device according to claim 1, wherein it is determined whether a warm-up of the image forming device is started by the return from the low-power mode, and the auxiliary power supply does not supply the stored DC power to the load if it is both determined that the warm-up of the image forming device is started by the return from the low-power mode and the predetermined processing is performed.

* * * * *